US006119967A

United States Patent [19]

Nakayama et al.

[11] Patent Number: 6,119,967

[45] Date of Patent: Sep. 19, 2000

[54] CONTROL CIRCUIT OF TRANSPORTABLE CRUSHER

[75] Inventors: Toru Nakayama, Kamakura; Yukio Tamura; Toshio Kitani, both of Kawasaki; Satoru Koyanagi, Tokyo; Yuji Ozawa, Yokohama; Yoshimitsu Yuzawa, Bisai; Katsuhiro Ikegami; Mikihisa Takiguchi, both of Kawasaki, all of Japan

[73] Assignee: Komatsu Ltd., Tokyo, Japan

[21] Appl. No.: 08/945,864

[22] PCT Filed: May 1, 1996

[86] PCT No.: PCT/JP96/01201

§ 371 Date: Nov. 30, 1997

§ 102(e) Date: Nov. 30, 1997

[87] PCT Pub. No.: WO96/34690

PCT Pub. Date: Nov. 7, 1996

[30] Foreign Application Priority Data

May 2, 1995 [JP] Japan ..... 7/132925

[51] Int. Cl.[7] ..... B02C 25/00

[52] U.S. Cl. ..... 241/34; 60/452; 91/446; 241/36; 241/101.74

[58] Field of Search ..... 91/446, 448, 512, 91/530, 447; 60/452; 241/101.74, 101.2, 34, 36

[56] References Cited

U.S. PATENT DOCUMENTS

| | | | |
|---|---|---|---|
| 5,062,350 | 11/1991 | Tanaka et al. | 91/448 |
| 5,101,629 | 4/1992 | Sugiyama et al. | 91/447 |
| 5,307,631 | 5/1994 | Tatsumi et al. | 60/452 |
| 5,333,449 | 8/1994 | Takahashi et al. | 91/448 |
| 5,409,038 | 4/1995 | Yoshida et al. | 91/446 |
| 5,580,004 | 12/1996 | Tamura et al. | 241/101.74 |
| 5,701,796 | 12/1997 | Takano et al. | 91/512 |

FOREIGN PATENT DOCUMENTS

| | | |
|---|---|---|
| 6-81641 | 11/1994 | Japan . |
| 7-3726 | 1/1995 | Japan . |

*Primary Examiner*—Mark Rosenbaum
*Attorney, Agent, or Firm*—Sidley & Austin

[57] ABSTRACT

A control circuit of a transportable crusher supplies, by the same pump, a required flow rate to hydraulic motors and actuators for a plurality of operating devices having different loads and improves simultaneous operability, fine adjustment, and reproducibility. The control circuit includes at least one variable displacement hydraulic pump (1) for supplying a hydraulic fluid; switch valves (12, 13, 14, 15, 16, 17, 18, 19, 20, 21), for conducting and interrupting the hydraulic fluid from the hydraulic pump (1) to the hydraulic motors and actuators (25*a*, 26*a*, 27*a*, 28*a*, 29*a*, 30*a*, 31*a*, 32*a*, 33*a*, 34*a*); pressure compensation control valves (11), for inputting front and back pressures of the switch valves, for controlling a discharge flow rate of the hydraulic pump (1) so that the difference of the front and back pressures can become constant and for distributing the discharge flow rate in accordance with a required power of the respective hydraulic motors and actuators or in accordance with a predetermined priority when the switch valves are simultaneously operated; and a controller (41), for controlling the switch valves to a predetermined value set in accordance with the load of the hydraulic motors and actuators.

30 Claims, 12 Drawing Sheets

CONTROL CIRCUIT OF TRANSPORTABLE CRUSHER

TECHNICAL FIELD

The present invention relates to a control circuit of a transportable crusher and more specifically to a control circuit of a transportable crusher which can perform an optimum hydraulic drive.

BACKGROUND ART

Heretofore, as this type of control circuit of transportable crusher, there has been proposed the control circuit of the transportable crusher shown in FIG. 14 (see Japanese Utility Model Laid-open No. 6-81641/1994).

In FIG. 14, a variable displacement left-side traveling hydraulic pump 101, a variable displacement right-side traveling hydraulic pump 102, and a fixed displacement controlling hydraulic pump 103 are driven by an engine (not shown) mounted in the transportable crusher.

A hydraulic fluid discharged from the left-side traveling hydraulic pump 101 flows into a P port of a left-side traveling switching control valve 104 (hereinafter, referred to as left-side control valve 104). This hydraulic fluid is supplied to a hydraulic motor 105 in a hydraulically drivable type forwardly reversely rotatable left-side traveling truck connected to an A port and a B port of the left-side control valve 104.

The hydraulic fluid discharged from the right-side traveling hydraulic pump 102 flows into the P port of a right-side traveling switching control valve 106 (hereinafter, referred to as a right-side control valve 106). This hydraulic fluid is supplied to a hydraulic motor 107 in a hydraulically drivable type forwardly reversely rotatable right-side traveling truck connected to the A port and the B port of the right-side control valve 106.

When the left-side control valve 104 is positioned at its neutral position S, the left-side control valve 104 is "an open-center type six-port and three-position pilot hydraulic control valve" which is communicated with the P port and an N port so as to bypass a flow. The left-side control valve 104 and the right-side control valve 106 have the same structure.

When each of the left-side control valve 104 and the right-side control valve 106 is positioned at its neutral position S, the hydraulic fluid discharged from the left-side traveling hydraulic pump 101 and the hydraulic fluid discharged from the right-side traveling hydraulic pump 102 flow out of the N ports. After that time, the hydraulic fluids are joined to each other and flow into the P port of a hydraulic control valve 108 for the crusher. This hydraulic fluid is supplied to a hydraulic motor 109 for the crusher connected to the A port and the B port of the hydraulic control valve 108 for the crusher. Two relief valves 110, 110 for the crusher are arranged in this control circuit in such a manner that a supplied hydraulic pressure is not a predetermined value or higher during a forward-and-reverse rotation of the hydraulic motor 109 for the crusher.

The hydraulic control valve 108 for the crusher also has the same structure as the left-side control valve 104 and the right-side control valve 106. When the hydraulic control valve 108 for the crusher is positioned at its neutral position S, its P port and its N port are communicated with each other so as to drain the hydraulic fluid into a tank 123.

When the left-side control valve 104 and the right-side control valve 106 are switching-controlled to their first switching position F so that the respective P port is communicated with the respective A port, the left-side hydraulic motor 105 and the right-side hydraulic motor 107 are rotated forwardly. On the other hand, when the left-side control valve 104 and the right-side control valve 106 are switching-controlled to their second switching position R so that the respective P port is communicated with the respective B port, the left-side hydraulic motor 105 and the right-side hydraulic motor 107 are rotated in reverse.

When the left-side hydraulic motor 105 and the right-side hydraulic motor 107 are driven, that is, when the hydraulic pressure from the respective P port is supplied to either the respective A port or the respective B port in the left-side control valve 104 and the right-side control valve 106, the respective N port for supplying the hydraulic pressure to the hydraulic control valve 108 for the crusher is always blocked. Thus, the hydraulic motor 109 for the crusher is not driven.

On the other hand, when the left-side control valve 104 and the right-side control valve 106 are positioned at their respective neutral position S, hydraulic pressure is supplied from the respective N port. The hydraulic motor 109 for the crusher is driven in accordance with the thus joined hydraulic pressure.

The controlling hydraulic pump 103 supplies hydraulic pressure to a control hydraulic line 111 which is connected to the left-side control valve 104, the right-side control valve 106, and the hydraulic control valve 108 for the crusher. The controlling hydraulic pump 103 also supplies the hydraulic pressure to hydraulic lines 112, 113, and 114, which are connected to the hydraulic motors for attached devices, such as a discharge conveyor, a magnetic separator, and a conveyor derricking device, by a shunt circuit 115.

The shunt circuit 115 is shunted into two systems by a first priority valve 116 on the discharge side of the controlling hydraulic pump 103. One outlet side port of the first priority valve 116 is connected to the hydraulic line 112, which is connected to the hydraulic motor for the discharge conveyor and to a first relief valve 117. The other outlet side port of the first priority valve 116 is connected to an inlet side port of a second priority valve 118.

Similarly, the outlet side port of the second priority valve 118 is connected to the hydraulic line 113 which is connected to the hydraulic motor for the magnetic separator and to a second relief valve 119. The other outlet side port of the second priority valve 118 is connected to the inlet side port of a third priority valve 120.

In a last step, one outlet side port of the third priority valve 120 is connected to the hydraulic line 114, which is connected to the hydraulic motor for the conveyor derricking device and to a third relief valve 121. The other outlet side port of the third priority valve 120 is held to a predetermined control pressure by a relief valve 122 for the control hydraulic line and is connected to the control hydraulic line 111.

Each hydraulic motor for these attached devices is connected so that the motor requiring the higher hydraulic pressure during an operation can be located in a previous step. The first, second, and third priority valves 116, 118, and 120 are constructed so that they can be shunted at a flow rate distribution ratio of as high as, for example, one to ten. The first, second, and third priority valves 116, 118, and 120 are arranged in accordance with the number of hydraulic motors.

A joined discharge flow rate from the left-side traveling hydraulic pump 101 and the right-side traveling hydraulic pump 102 is supplied to the hydraulic motor 109 for the crusher so that the speed may not be reduced if the load and a load variation become larger.

The hydraulic motors for the discharge conveyor, for the magnetic separator, and for the conveyor derricking device have less displacement and less load variation than the hydraulic motor 109 for the crusher. However, the controlling hydraulic pump 103 for the control hydraulic line 111 and for the hydraulic lines 112, 113, and 114 for the attached devices is a fixed displacement type having a large pump displacement. The controlling hydraulic pump 103 includes the shunt circuit 115 which shunts the excess discharge flow rate. The controlling hydraulic pump 103 is used through the priority valves 116, 118, and 120 of the shunt circuit 115.

Accordingly, the two variable displacement traveling hydraulic pumps 101 and 102, for use with the hydraulic motor 109 for the crusher, and the single fixed displacement controlling hydraulic pump 103, for use with both the control hydraulic line 111 and the attached devices, have no influence on each other, even if the loads of both the pumps are varied. Thus, they can be independently driven.

FIG. 15 shows an example of a prior-art speed control circuit of a hydraulic motor 124 for a feeder. This speed control circuit controls a speed of the hydraulic motor 124 for the feeder in order to select an introduction speed of objects to be crushed in accordance with the size and hardness of the objects to be crushed and the kind of crusher used for crushing the objects.

A speed control of the hydraulic motor 124 for the feeder is accomplished by a bleed-off circuit in which a flow rate regulating valve 125 is inserted between the discharge side of the hydraulic pump 103 and a tank 123. A discharge flow rate Qp of the hydraulic pump 103 is divided into a flow rate $Q_M$ to be supplied to the hydraulic motor 124 for the feeder and a flow rate $Q_T$ to be shunted to the tank 123. The excess flow rate $Q_T$ is regulated by the flow rate regulating valve 125. The flow rate $Q_M$, alone required for the hydraulic motor 124 for the feeder, is supplied through a switching control valve 126 for the feeder.

On the other hand, the conventional control circuit of the transportable crusher includes the two variable displacement traveling hydraulic pumps 101 and 102. The reason is as follows. When the load of the left-side hydraulic motor 105 is different from that of the right-side hydraulic motor 107, even if the left-side control valve 104 and the right-side control valve 106 have the same stroke, the hydraulic fluid flows into the hydraulic motor having the lower load. Therefore, since the speed of the hydraulic motor having the higher load becomes lower, the transportable crusher cannot travel in a straight line. Thus, the two traveling hydraulic pumps 101 and 102 are disposed so as to ensure straight traveling. However, this complicates the piping system and the control system, and a maintenance check takes a long time, thereby resulting in a high cost.

The left-side control valve 104 and the right-side control valve 106 are the open-center type in which the respective P port and the respective N port are communicated with each other at the neutral position S. Thus, during each half stroke, the hydraulic fluid, set to a predetermined pressure at the P port, is partially drained into the tank 123 via the P port and the N port of the hydraulic control valve 108 for the crusher. If a drain flow rate is high, a power loss of the traveling hydraulic pumps 101 and 102 is caused. If the drain flow rate remains high for a long time, the hydraulic fluid is heated, thereby causing an overheating of the hydraulic circuit. In such a manner, a problem is caused.

When the single fixed displacement controlling hydraulic pump 103, for use in both the control hydraulic line 111 and the hydraulic lines 112, 113, and 114 for the attached devices, is installed, a large pump displacement is required for the total flow rate necessary for these lines.

For example, with regard to the crusher broadly illustrated in FIG. 3, the controlling hydraulic pump 103, having a larger pump displacement, is also required in order to supply the hydraulic fluid to each hydraulically drivable type motor for a feeder 29 for stably supplying the objects to be crushed which are introduced into the hopper for crusher 28, a vibrating screen 32, a plurality of secondary conveyors 33 and 34, etc.

In addition, the shunt circuit 115, having a different predetermined set pressure, is disposed on the discharge side of the controlling hydraulic pump 103. As the number of attached devices is increased as described above, the priority valve and the relief valve for the control hydraulic line, to be mounted to each hydraulic line, must be increased. As a result, the drain flow rate is further increased, thereby resulting in further power loss of the controlling hydraulic pump 103. Since the hydraulic fluid is heated, the hydraulic circuit can become overheated. Since the piping system and the control system are complicated, the maintenance check takes a long time.

Furthermore, assume that the discharge conveyor is overloaded, that is, the objects to be crushed are discharged over a predetermined throughput capacity of the discharge conveyor. At that time, the first relief valve 117, of the hydraulic line 112 connected to the hydraulic motor for the discharge conveyor, is relieved; and thereby the hydraulic motor 109 for the crusher and the feeder are automatically stopped. Although an operator can restart the motor and the feeder after a check of the failure, this is troublesome.

The speed control circuit of the hydraulic motor 124 for the feeder shown in FIG. 15 selects the flow rate $Q_M$ required for the hydraulic motor 124 for the feeder by the flow rate regulating valve 125 and regulates the flow rate $Q_T$ to be shunted to the tank 123. However, when the load and an oil temperature of the hydraulic fluid are varied in accordance with the amount of the objects, to be crushed, on the feeder, the flow rate $Q_M$ is changed and thereby the speed of the hydraulic motor 124 for the feeder is also changed. Disadvantageously, the reduction of the speed of the hydraulic motor 124 for the feeder results in a reduction of crushing efficiency.

According to the circumstances of the load and the oil temperature of the hydraulic fluid, the crusher can be abnormally overloaded. Thus, the objects to be crushed jam the crusher, thereby resulting in an emergency stop. Immediately before the abnormal overload, it is difficult for the operator to regulate the flow rate regulating valve 125. It is also very difficult to remote-control the flow rate regulating valve 125, which is incorporated in the structure of the switching control valve 126 for the feeder.

Even if the load of the hydraulic motor 124 for the feeder is reduced, the jammed objects to be crushed must be removed from the crusher in an emergency-stop status. Therefore, since an automatic restoration is difficult, the operating efficiency of the transportable crusher is reduced.

SUMMARY OF THE INVENTION

The present invention is accomplished in view of such problems of the prior art. It is a first object of the present invention to provide a control circuit of a transportable crusher which supplies, by the same pump, a required flow rate to hydraulic motors and actuators for a plurality of operating devices having different loads, and improves simultaneous operability, fine adjustment, and reproducibility. It is a second object of the present invention to provide a control circuit of a transportable crusher which prevents an overload of each device by setting an order of priority of operation/stop for a plurality of operating devices and has safety during the traveling of the transportable crusher.

The present invention provides a control circuit of a transportable crusher having hydraulic units for a plurality of operating devices having different loads, for crushing objects to be crushed by the crusher, wherein each hydraulic unit is either a hydraulic motor or an actuator, the control circuit comprising at least one variable displacement hydraulic pump for supplying a hydraulic fluid, switch valves for conducting and interrupting the hydraulic fluid from the hydraulic pump to the hydraulic units, pressure compensation control valves for inputting front and back pressures of the switch valves, for controlling a discharge flow rate of the hydraulic pump so that the difference of the front and back pressures can become constant, and for distributing the discharge flow rate in accordance with the power required by the respective hydraulic units or in accordance with a predetermined priority when the switch valves are simultaneously operated, and control means for controlling the switch valves to a predetermined value set in accordance with the load of the hydraulic units.

A spool of a feeder valve, for controlling a speed of a feeder which is one of the plurality of operating devices, includes, in one part of a tapered notch portion for flowing a predetermined flow rate proportional to an opening area of the spool in accordance with a flow rate required by a hydraulic motor for the feeder, a parallel notch portion which is parallel to the spool outer circumference for allowing the flow rate to be constant even if the amount of movement of the spool is increased.

In the control circuit, the control means comprises comparators for comparing signals, inputted from detecting means for detecting the load of the hydraulic motors for driving the plurality of operating devices, to an equivalent load level to which a setter presets the load of the feeder, and an output circuit for outputting an instruction signal to a solenoid proportional reducing valve of the feeder in response to output signals of the comparators and for controlling the speed of the feeder.

In the control circuit, the control means comprises a current pattern A of a first speed control for starting, accelerating/decelerating, and stopping the hydraulic motor of the feeder, and a current pattern B of a second speed control for starting, accelerating/decelerating, and operating at a set value speed, and an instruction is given to the solenoid proportional reducing valve in accordance with one of the current patterns selected by an identification switch so as to control the speed of the feeder.

In the control circuit, a discharge conveyor, which is one of the plurality of operating devices, comprises a position sensor, for detecting a storing position, connected to the control means through a power source circuit. The position sensor is turned OFF when the discharge conveyor is positioned at a lower position during a crushing operation, and a signal from the control means to a traveling interlock solenoid valve of the transportable crusher is turned OFF so that the traveling of the transportable crusher is prevented.

The position sensor is connected to a rotating light and an alarm for displaying the traveling of the transportable crusher, and the position sensor is turned ON when the discharge conveyor is positioned at an upper position during a stop of the operation so that the rotating light and the alarm are actuated.

In such a construction, the discharge flow rate of the single hydraulic pump is supplied in parallel to the hydraulic motors and actuators for a plurality of operating devices having different loads. This hydraulic pump includes the pressure compensation control valves for inputting the front and back pressures of the closed-center type switch valves, which individually control the hydraulic fluid to the hydraulic motors and actuators, and for controlling the discharge flow rate of the pump so that these front and back pressures can become constant.

Regardless of the size of the load of each hydraulic motor and actuator, each switch valve distributes the discharge flow rate of the hydraulic pump into each hydraulic motor and actuator in accordance with the opening area of the respective switch valve. Therefore, the driving speed of the large displacement hydraulic motor for the crusher is actuated at a predetermined speed, even if the load of the large displacement hydraulic motor is varied. The driving speed of the motor for the feeder, the discharge conveyor, etc., is also actuated at a predetermined speed in the same manner.

As a result, the crusher crushes the objects to be crushed, at a constant speed and delivers the crushed objects to the discharge conveyor. Therefore, fewer emergency stops are caused, due to the overload of the crusher and the discharge conveyor, without reducing crushing efficiency.

The hydraulic pump is not specifically divided into one for the crusher and others for other operating devices. The variable displacement hydraulic pump having a single discharge flow rate can be disposed in accordance with the total required power. Accordingly, the single hydraulic pump is controlled so as to minimize the flow rate of the pressurized oil to be relieved from a relief valve to a tank in order to hold the pressure. Therefore, a heat generation of the hydraulic fluid in the tank is reduced.

Each switch valve and each pressure compensation valve connected to each hydraulic motor and each actuator control the flow rate which distributes the discharge flow rate of the hydraulic pump into each hydraulic motor and each actuator. Thus, while the objects to be crushed, which are introduced into the hopper, are crushed by the crusher, the hydraulic motor of any one of the feeder, the crusher, or the discharge conveyor can be overloaded. At that time, the discharge flow rate of the pump is distributed, for example, in the order of the crusher, the discharge conveyor, and the feeder in accordance with a predetermined priority.

The control of the switch valves is effected by the solenoid proportional reducing valves and the solenoid valves. In order to control the valves in the order of priority, the control means first instructs the solenoid proportional reducing valve for the feeder to stop the feeder so as to stop feeding the objects to be crushed, to the crusher. Next, the control means instructs the solenoid valve for the discharge conveyor to stop the discharge conveyor after a predetermined time interval so as to stop the discharge conveyor. Within a predetermined time interval, the crusher crushes the objects to be crushed in the crusher, and then discharges the crushed objects to the discharge conveyor. Finally, the control means gives the instruction to stop the crusher so as to stop the crusher. Accordingly, the crushed objects are not jammed into the crusher and do not remain on the discharge conveyor. Therefore, even if each hydraulic motor is overloaded, an action is performed so that the load can be sequentially reduced. Thus, the control circuit is easy to automatically restore, thereby improving the crushing efficiency. Since the crushed objects in the crusher and on the discharge conveyor are discharged, a check and maintenance work of the crusher and the discharge conveyor is also facilitated.

The spool of the feeder valve for controlling the speed of the feeder includes, in one part of the tapered notch for flowing a predetermined flow rate proportional to the opening area of the spool in accordance with a required flow rate of the hydraulic motor for the feeder, the parallel notch portion, which is parallel to the spool outer circumference. Thus, when the feeder valve is operated, there is formed a portion where the flow rate becomes constant even if the opening area of the feeder valve is increased, that is, the portion where the speed becomes constant in a status of the speed of set value. The portion having the speed of set value is set so that the feeder valve can be easily operated in speed stages of rated speed and set value speed. Thus, a fine rotation control becomes possible during the high load of the feeder. By adjusting the grit of the crushed objects, the grit of product desired by a user can be ensured.

The control means outputs an instruction to the solenoid proportional reducing valve inserted in a pilot circuit of the feeder valve. The control means compares each signal, inputted from each detecting means for detecting the load of each hydraulic motor for driving a plurality of operating devices, to the equivalent load level to which the setter presets the load of the feeder. The instruction signal is outputted to the solenoid proportional reducing valve of the feeder from the output circuit in response to the outputted signal. The feeder is started, accelerated/decelerated, operated at the set value speed, or stopped.

The control means also comprises the current pattern A of the first speed control for starting, accelerating/decelerating, and stopping the hydraulic motor of the feeder and the current pattern B of the second speed control for starting, accelerating/decelerating, and operating at the set value speed. The identification switch can select either current pattern. The current pattern A of the first speed control can be used for a plate feeder. The current patter B of the second speed control can be used for a vibrating feeder having a resonant point at a low speed just before the stop. When the current pattern B of the second speed control is used for the vibrating feeder, the vibrating feeder is operated at the set value speed prior to resonating. After the reduction of the load of the crusher and the discharge conveyor, an automatic restoration for accelerating the vibrating feeder up to the rated speed is facilitated. The crushing efficiency is improved. Furthermore, even if the hydraulic motors for the plate feeder and for the vibrating feeder have different performances, the common hydraulic pump and the switch valves can be used.

When the discharge conveyor is positioned at the lower position during the operation, the position sensor is turned OFF. The signal from the control means to the traveling interlock solenoid valve of the transportable crusher is turned OFF. The transportable crusher cannot travel. Therefore, if the operator should inadvertently press a traveling lever during the crushing operation, the transportable crusher does not travel, thereby allowing the safety to be ensured.

When the discharge conveyor is positioned at the upper position during the stop of the crushing operation, the position sensor is turned ON. The rotating light and the alarm are actuated so as to display the traveling of the transportable crusher.

BEST MODE FOR CARRYING OUT THE INVENTION

An embodiment of a control circuit of a transportable crusher according to the present invention will be described in detail with reference to FIGS. 1 through 13B.

Figure 1:
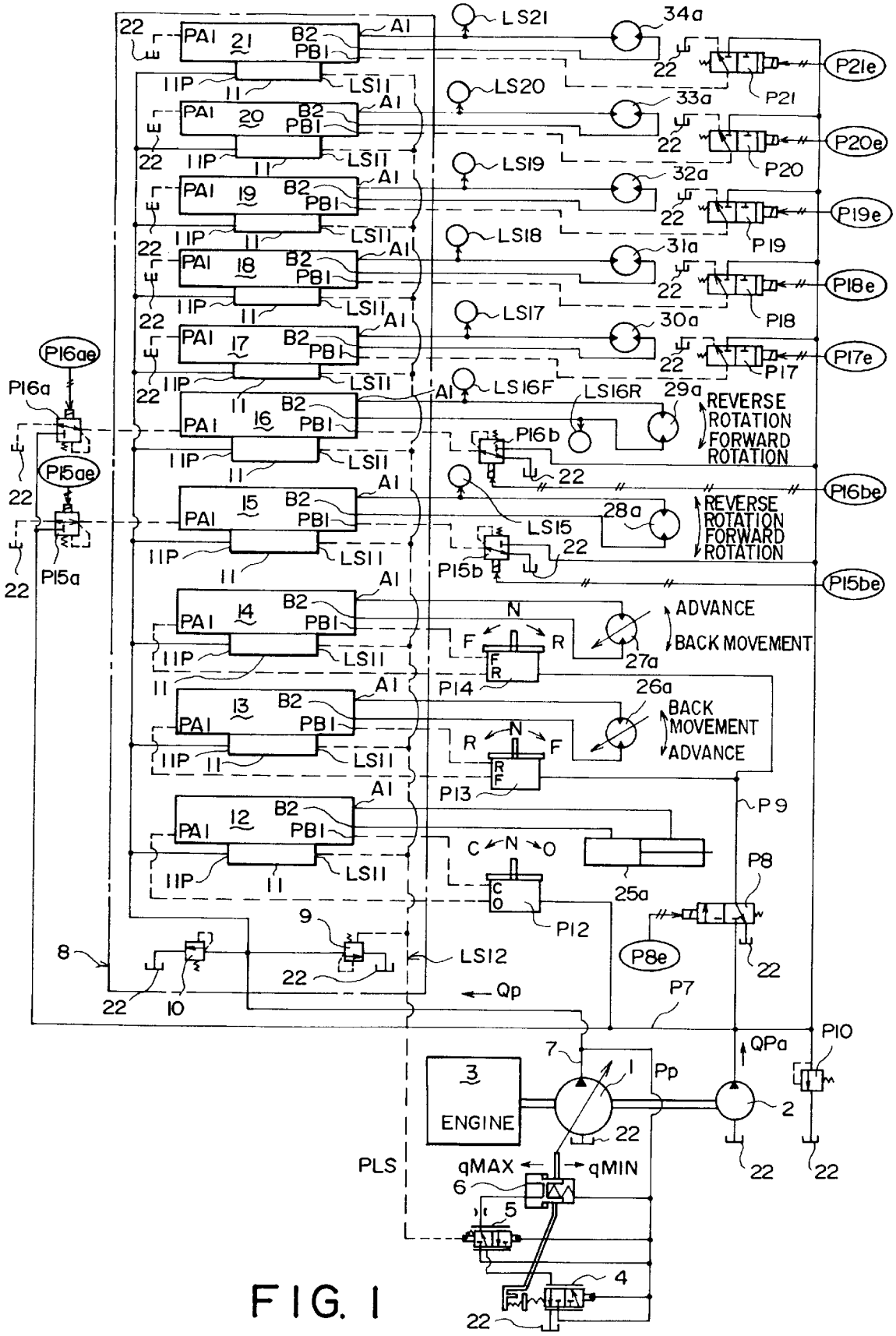
FIG. 1 is a hydraulic circuit diagram of a control circuit of a transportable crusher according to an embodiment of the present invention.

As shown in FIG. 1, a variable displacement hydraulic pump 1 and a fixed displacement controlling hydraulic pump 2 are driven together by an engine 3, which is mounted to the transportable crusher. The hydraulic pump 1 includes a TVC (Torque Variable Control) valve 4, an LS (Load Sensing) valve 5, and a servo piston 6.

The TVC valve 4 is a three-port and two-position proportional flow rate control valve. The TVC valve 4 controls an angle of an inclined plate of the hydraulic pump 1 by the servo piston 6 so that a pump absorbing torque can be maintained to the extent that the engine 3 is not stopped. That is, when a pump discharge hydraulic pressure Pp is increased, the amount of discharge Qp of the hydraulic pump 1 is reduced. On the other hand, when the pump discharge hydraulic pressure Pp is reduced, the amount of discharge Qp is increased.

The LS valve 5 is a three-port and two-position proportional flow rate control valve. The LS valve 5 is controlled by the discharge hydraulic pressure Pp of the hydraulic pump 1 and an LS pressure PLS, which is generated in a load pressure circuit LS12 of each hydraulic motor connected to an outlet port LS11 of each pressure compensation valve 11 in an operating valve assembly 8. The LS valve 5 is balanced by the discharge hydraulic pressure Pp and the LS pressure PLS so that an LS differential pressure can be always constant. When the LS differential pressure is lower than a set pressure of the LS valve 5, the LS valve 5 actuates the servo piston 6 so as to increase the angle of the inclined plate, thereby increasing the amount of pump discharge Qp. On the contrary, when the LS differential pressure is higher than the set pressure of the LS valve 5, the LS valve 5 reduces the angle of the inclined plate, thereby reducing the amount of pump discharge Qp.

The servo piston 6 sets a reference pressure to the discharge hydraulic pressure Pp and sets a control pressure to the LS differential pressure. The angle of the inclined plate of the hydraulic pump 1 is variably actuated so as to vary the amount of pump discharge Qp.

On a discharge side of the hydraulic pump 1 is disposed the stack-shaped operating valve assembly 8 which switching-controls a flow rate distribution and a direction of flow of hydraulic pressure from the hydraulic pump 1 through an oil path 7 and can increase/reduce the number of units so that number can be the necessary number for the switching control. The oil path 7 is connected to each of a plurality of inlet ports 11P disposed in the operating valve assembly 8.

The operating valve assembly 8 comprises, besides the pressure compensation valves 11, closed-center type switch valves such as an unload valve 9 and a relief valve 10 for controlling the pressure, a crusher case opening/closing valve 12, a left traveling valve 13, a right traveling valve 14, a crusher valve 15, a feeder valve 16, a discharge conveyor valve 17, a magnetic separator valve 18, a vibrating screen valve 19, a secondary loading conveyor valve 20, and a secondary stock conveyor valve 21. On the inlet sides of the switch valves are disposed the pressure compensation valves 11, which are connected in parallel to the oil path 7 and balance one load pressure with another load pressure.

The valves described below are connected in parallel through a pilot oil path P7 on the discharge side of the controlling hydraulic pump 2. That is, a case opening/closing PPC valve (direct acting proportional reducing valve) P12 is connected so as to pilot-operate the crusher case opening/closing valve 12. An EPC valve (solenoid proportional reducing valve) P15*a,* for forwardly rotating the crusher and an EPC valve 15*b,* for reversely rotating the crusher, are connected so as to pilot-operate the crusher valve 15. An EPC valve P16*a,* for forwardly rotating the feeder, and an EPC valve 16*b,* for reversely rotating the feeder, are connected so as to pilot-operate the feeder valve 16.

The controlling hydraulic pump 2 discharges an amount of discharge Qpa. A relief valve P10 is disposed on the discharge side of the controlling hydraulic pump 2.

To the pilot oil path P7 are similarly connected in parallel a three-port and two-position traveling interlock solenoid valve P8, a discharge conveyor rotating solenoid valve P17 for pilot-operating the discharge conveyor valve 17, a magnetic separator solenoid valve P18 for pilot-operating the magnetic separator valve 18, a screen solenoid valve P19 for pilot-operating the vibrating screen valve 19, a loading conveyor solenoid valve P20 for pilot-operating the secondary loading conveyor valve 20, and a stock conveyor solenoid valve P21 for pilot-operating the secondary stock conveyor valve 21.

A left traveling PPC valve P13, for pilot-operating the left traveling valve 13, and a right traveling PPC valve P14, for pilot-operating the right traveling valve 14, are connected in parallel through a pilot oil path P9 to the outlet port of the traveling interlock solenoid valve P8, which is switched by a signal P8*e.*

To the control ports A1 and B2 of the crusher case opening/closing valve 12 is connected an actuator 25*a* for opening/closing the crusher case 25 when the crusher 28 is set up. A port O of the case opening/closing PPC valve P12 is connected to a hydraulic port PA1 of the crusher case opening/closing valve 12. A port C of the case opening/closing PPC valve P12 is connected to a hydraulic port PB1 of the crusher case opening/closing valve 12 in a similar manner.

To the control ports A1 and B2 of the left traveling valve 13 is connected a hydraulic motor 26*a* in a hydraulically drivable type forwardly reversely rotatable left-side traveling truck 26. A port F of the left traveling PPC valve P13 is connected to the hydraulic port PA1 of the left traveling valve 13. A port R of the left traveling PPC valve P13 is connected to the hydraulic port PB1 of the left traveling valve 13 in a similar manner.

To the control ports A1, B2 of the right traveling valve 14 is connected a hydraulic motor 27*a* in a hydraulically drivable type forwardly reversely rotatable right-side traveling truck 27. The port F of the right traveling PPC valve P14 is connected to the hydraulic port PA1 of the right traveling valve 14. The port R of the right traveling PPC valve 14 is connected to the hydraulic port PB1 of the right traveling valve 14 in a similar manner.

To the control ports A1 and B2 of the crusher valve 15 are connected a forwardly reversely rotatable hydraulic motor 28*a,* for operating the crusher 28 to crush objects to be crushed, and a sensor LS15, for detecting the load pressure of the hydraulic motor 28*a.*

The hydraulic port PA1 of the crusher valve 15 is connected to the outlet port of the EPC valve P15*a,* which is controlled by a proportional current of a signal P15*ae,* for forwardly rotating the crusher. The hydraulic port PB1 of the crusher valve 15 is similarly connected to the outlet port of the EPC valve P15*b,* which is controlled by the proportional current of a signal P15*be,* for reversely rotating the crusher.

To the control ports A1 and B2 of the feeder valve 16 are connected a forwardly reversely rotatable hydraulic motor 29*a,* for the feeder 29 for delivering a fixed quantity of objects to be crushed from the hopper 35 to the crusher 28, and the sensors LS16F and LS16R, for detecting the load pressure of the hydraulic motor 29*a.*

The hydraulic port PA1 of the feeder valve 16 is connected to the outlet port of the EPC valve P16*a,* which is controlled by the proportional current of a signal P16*ae,* for forwardly rotating the feeder. The hydraulic port PB1 of the feeder valve 16 is also connected to the outlet port of the EPC valve P16*b,* which is controlled by the proportional current of a signal P16*be,* for reversely rotating the feeder.

To the control ports A1 and B2 of the discharge conveyor valve 17 are connected a hydraulic motor 30*a,* for rotating a discharge conveyor 30 to discharge the objects crushed by the crusher 28, and a sensor LS17, for detecting the load pressure of the hydraulic motor 30*a.* The hydraulic port PA1 of the discharge conveyor valve 17 is connected to a tank 22. The hydraulic port PB1 of the discharge conveyor valve 17 is also connected to the outlet port of the discharge conveyor rotating solenoid valve P17, which is switched by a signal P17*e.*

To the control ports A1 and B2 of the magnetic separator valve 18 are connected a hydraulic motor 31*a* for rotating a magnetic separator 31, for separating magnetic metal pieces such as an iron mixed in the crushed objects on the discharge conveyor 30, and a sensor LS18, for detecting the load pressure of the hydraulic motor 31*a.* The hydraulic port PA1 of the magnetic separator valve 18 is also connected to the tank 22. The hydraulic port PB1 of the magnetic separator valve 18 is also connected the outlet port of the magnetic separator solenoid valve P18, which is switched by a signal P18*e.*

To the control ports A1 and B2 of the vibrating screen valve 19 are connected a hydraulic motor 32*a,* for rotating a vibrating screen 32, and a sensor LS19, for detecting the load pressure of the hydraulic motor 32*a.* The hydraulic port PA1 of the vibrating screen valve 19 is connected to the tank 22. The hydraulic port PB1 of the vibrating screen valve 19 is also connected to the outlet port of the screen solenoid valve P19, which is switched by a signal P19*e*.

To the control ports A1 and B2 of the secondary loading conveyor valve 20 are connected a hydraulic motor 33*a*, for rotating a secondary loading conveyor 33, and a sensor LS20, for detecting the load pressure of the hydraulic motor 33*a*. The hydraulic port PA1 of the secondary loading conveyor valve 20 is connected to the tank 22. The hydraulic port PB1 of the secondary loading conveyor valve 20 is connected to the outlet port of the loading conveyor solenoid valve P20, which is switched by a signal P20*e*.

To the control ports A1 and B2 of the secondary stock conveyor valve 21 are connected a hydraulic motor 34*a*, for rotating a secondary stock conveyor 34, and a sensor LS21, for detecting the load pressure of the hydraulic motor 34*a*. The hydraulic port PA1 of the secondary stock conveyor valve 21 is connected to the tank 22. The hydraulic port PB1 of the secondary stock conveyor valve 21 is connected to the outlet port of the stock conveyor solenoid valve P21, which is switched by a signal P21*e*.

The unload valve 9 is a valve for relieving the amount of discharge Qp, corresponding to the minimum angle of the inclined plate of the hydraulic pump 1, into the tank 22 at an unload pressure Pap when each switch valve constituting the operating valve assembly 8 is positioned at a neutral position. The unload valve 9 is constructed so that the aforementioned LS pressure PLS can act upon a vent circuit of the unload valve 9. During a fine operation of each switch valve, the unload valve 9 relieves one part of the amount of discharge Qp of the hydraulic pump 1 into the tank 22. The discharge hydraulic pressure Pp is increased up to the pressure which is equal to the unload pressure Pap plus the LS pressure PLS.

The relief valve 10 is a safety valve for relieving the amount of discharge Qp into the tank 22 and for reducing to a predetermined pressure when the discharge oil path 7 of the hydraulic pump 1 is increased to a predetermined pressure or higher. The relief valve P10 is the safety valve for relieving the amount of discharge Qpa into the tank 22 and for reducing to a predetermined pressure when the discharge oil path P7 of the hydraulic pump 2 is increased to a predetermined pressure or higher.

Figure 2:
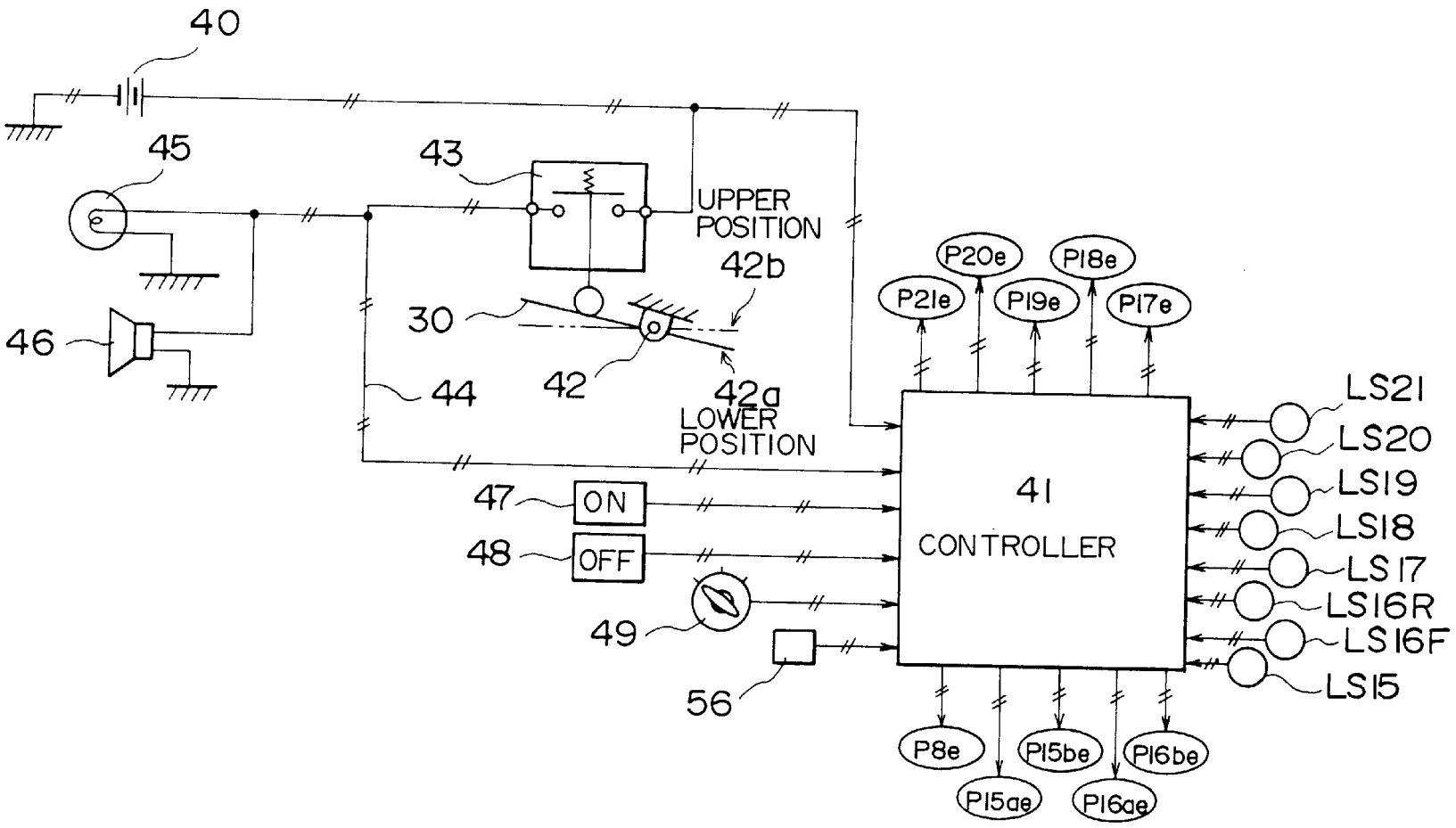
FIG. 2 is a block diagram of a controller for the control circuit shown in FIG. 1.

As shown in FIG. 2, to a mounted battery 40 are connected a controller 41, which is a control means, and a limit switch 43, which is one of the position sensors. During the operation of the discharge conveyor 30, the discharge conveyor 30 is positioned at a lower position 42*a* about a fulcrum of a pivot pin 42. Therefore, the limit switch 43 is turned OFF so as to disconnect a power source circuit 44.

At this time, the power source circuit 44 inputs a signal to the controller 41 so that the output signal P8*e* of the controller 41 is turned OFF. The pilot oil path P9, connected to the traveling interlock solenoid valve P8, communicates with the tank 22. If either the left traveling PPC valve P13 or the right traveling PPC valve P14 is operated, the interlock is carried out so that the transportable crusher can not travel.

A rotating light 45 and an alarm 46 are connected to the power source circuit 44. During the traveling of the transportable crusher, the discharge conveyor 30 is positioned at an upper position 42*b* about the fulcrum of the pivot pin 42. Therefore, the limit switch 43 is turned ON so as to connect the power source circuit 44. The rotating light 45 and the alarm 46 are actuated.

Figure 3:
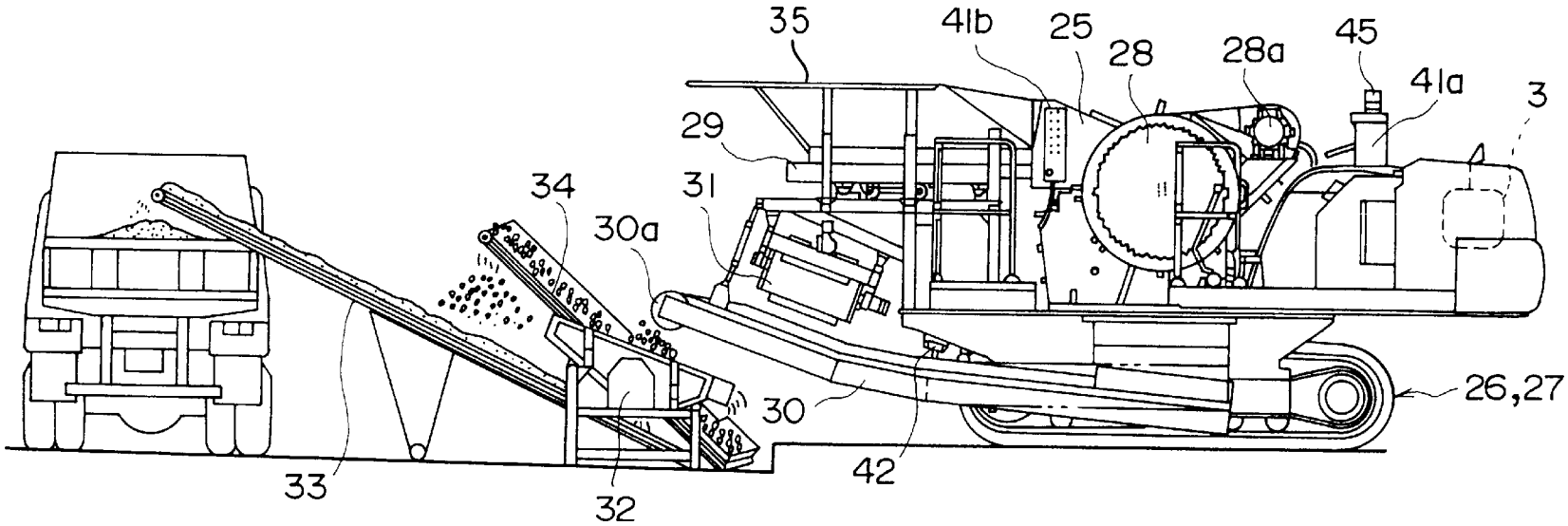
FIG. 3 is a side view of a transportable crusher mounting the control circuit and the controller shown in FIGS. 1 and 2.

As shown in FIG. 3, the controller 41 is divided into a main controller 41*a* and a remote controller 41*b*, which can remote-control a working machine.

As shown in FIGS. 2 and 3, signals are inputted to the controller 41 from the feeder switches 47 and 48, which can manually turn ON/OFF the feeder 29; a speed setter 49, which can set the speed of the feeder 29; and a feeder identification switch 56. The feeder identification switch 56 is for identifying a plate feeder and a grizzly vibrating feeder in the feeder 29 and for inputting the signal, where the grizzly vibrating feeder vibrates a grizzly bar so as to discharge the objects to be crushed finer than the grit of the grizzly bar before the introduction into the crusher 28.

Signals are also inputted to the controller 41 from the sensors LS15, LS16F, LS16R, LS17, LS18, LS19, LS20, and LS21, which are detecting means for detecting the load of the respective hydraulic motor. The signals P8*e*, P15*ae*, P15*be*, P16*ae*, P16*be*, P17*e*, P18*e*, P19*e*, P20*e* and P21*e* are then outputted.

Figure 4:
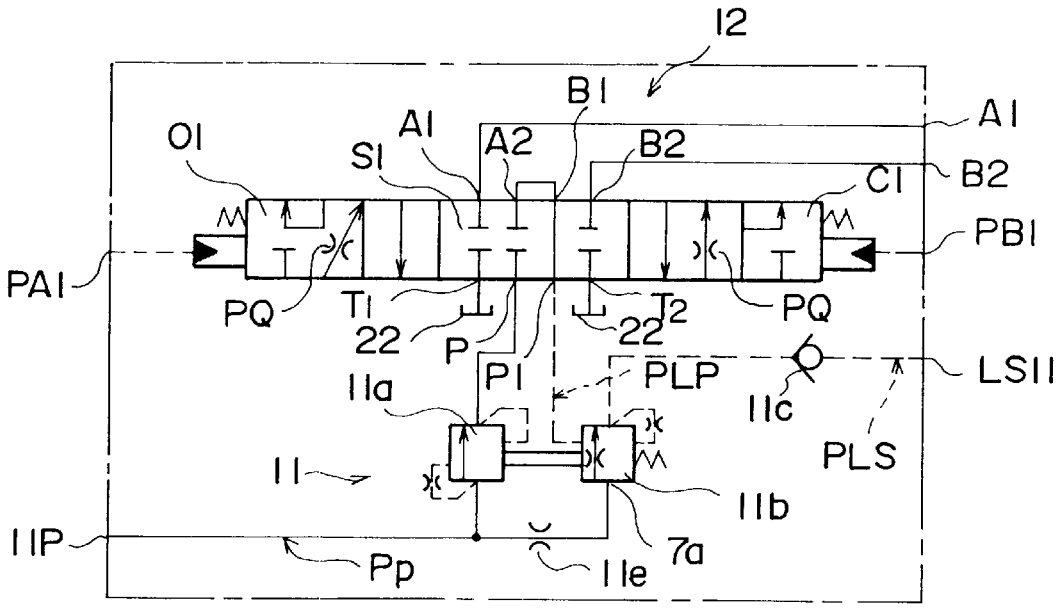
FIG. 4 is an illustration of an opening/closing valve of a crusher case.

In FIG. 4, the pressure compensation valve 11 is a composite valve in which a flow rate regulating valve 11*a* is coupled to a reducing valve 11*b*. The differential pressure becomes constant in a flow rate control mechanism PQ between the inlet pump port P and the outlet control port A1 or B2 of the crusher case opening/closing valve 12. At that time, even if the pressure compensation valve 11 is operated together with other switch valves, it acts so that the differential pressure can become the same.

The pressure compensation valve 11 puts the hydraulic pressure Pp into an inlet port 7*a* through a throttle 11*e*. The reducing valve 11*b* is used so as to reduce to the same pressure as a load pressure PLP of the actuator 25*a*. The top pressure is fetched at the outlet of the operating valve assembly 8 through a check valve 11*c* so that the top pressure is defined as the LS pressure PLS.

The crusher case opening/closing valve 12 is a closed-center type of eight-port and three-position spring center pilot operated type switch valve. The eight ports include a pump port P, connected to the outlet of the flow rate regulating valve 11*a* as the inlet port; a pilot port P1, of the load pressure PLP for controlling the reducing valve 11*b* to the LS pressure PLS; and two tank ports T1 and T2. The control ports A1 and A2 and the control ports B1 and B2 are disposed as the outlet ports. The oil path of the control port A2 is coupled to that of the control port B1. The two tank ports T1 and T2 are connected to the tank 22.

The three positions include a neutral position S1 of a spring center having "P1, B1 connection" and other ports closed; a case opening position 01, having "P, B1 connection with the flow rate control mechanism PQ", "B2, T2 connection", "B1, P1 connection", "A2, A1 connection" and T1 closed; and a case closing position C1, having "P, A2 connection with the flow rate control mechanism PQ", "B1, B2, P1 connection", "A1, T1 connection", and T2 closed.

Hydraulic chambers PA1 and PB1, for pilot-operating the case opening position 01 and the case closing position C1, and springs are disposed at both ends of the crusher case opening/closing valve 12.

Figure 5:
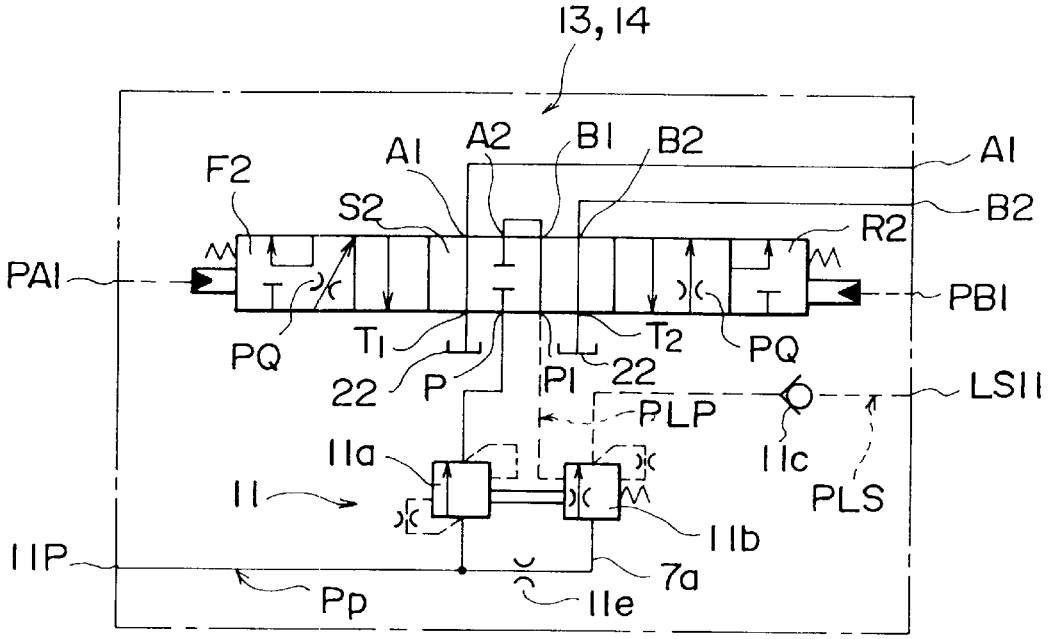
FIG. 5 is an illustration of right and left traveling valves.

In FIG. 5, the pressure compensation valve 11 has the same structure as in FIG. 4. Since the same components have the same reference numbers, the description is omitted.

The neutral position S1 of the left traveling valve 13 and the right traveling valve 14 has "A1, T1 connection", "B2, T2 connection", "P1, B1 connection", and P, A2 closed. The oil path of the control port A2 is coupled to that of the control port B1. The two tank ports T1 and T2 are connected to the tank 22. The connection position of each port of other advance position F2 and back position R2 is the same as the case opening position 01 and the case closing position C1. Thus, the description is omitted.

Figure 6:
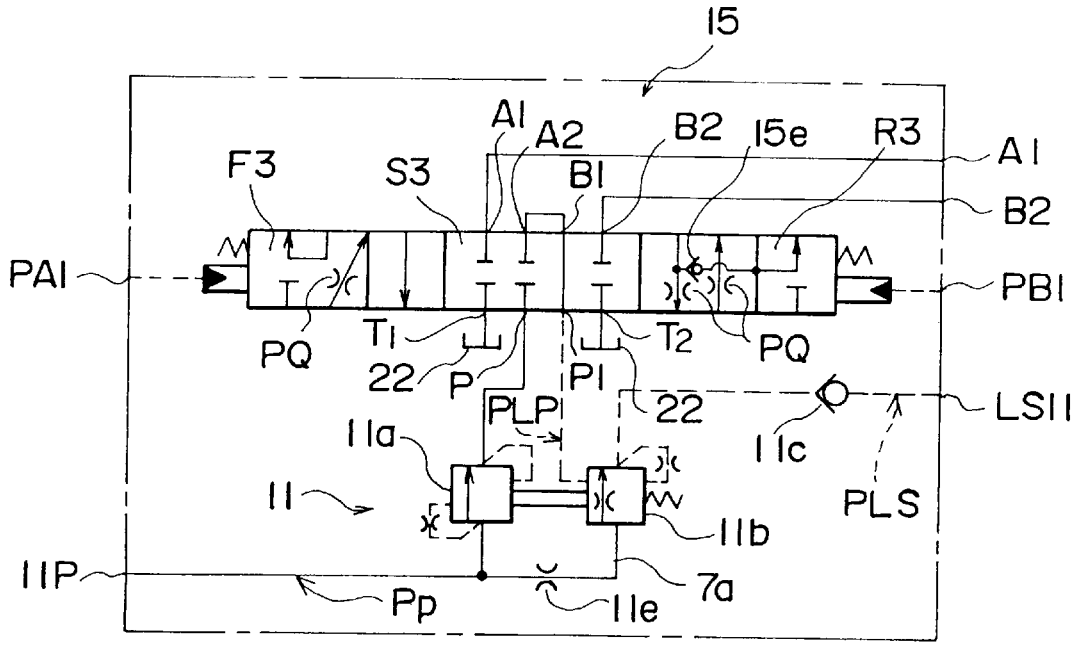
FIG. 6 is an illustration of a crusher valve.

In FIG. 6, the pressure compensation valve 11 has the same structure as in FIG. 4. Since the same components have the same reference numbers, the description is omitted.

At a reverse position R3 of the crusher valve 15 are disposed "P, A2 connection with the flow rate control mechanism PQ", "P1, B1, B2 connection", the check valve 15*e* for flowing from a direction of A1 to a direction of B2, and "A1, T1 connection with the flow rate control mechanism PQ,". The connection position of each port of a neutral position S3 and a forward position F3 is the same as the neutral position S1 and the case opening position 01 of the crusher case opening/closing valve 12. Thus, the description is omitted.

Figure 7:
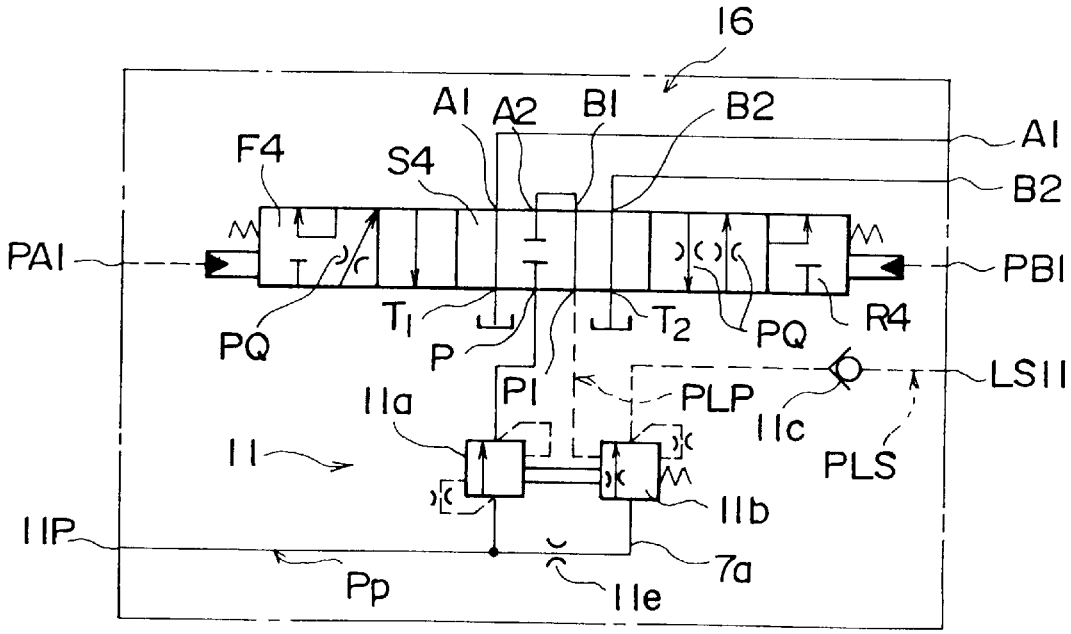
FIG. 7 is an illustration of a feeder valve.

In FIG. 7, the pressure compensation valve 11 has the same structure as in FIG. 4. Since the same components have the same reference numbers, the description is omitted.

The feeder valve 16 is the same eight-port and three-position spring center pilot operated type switch valve as the left traveling valve 13 and the right traveling valve 14. However, since the flow rate control mechanisms PQ differ between a forward position F4 and a reverse position R4, this will be described in detail with reference to FIGS. 8, 9A and 9B.

Figure 8:
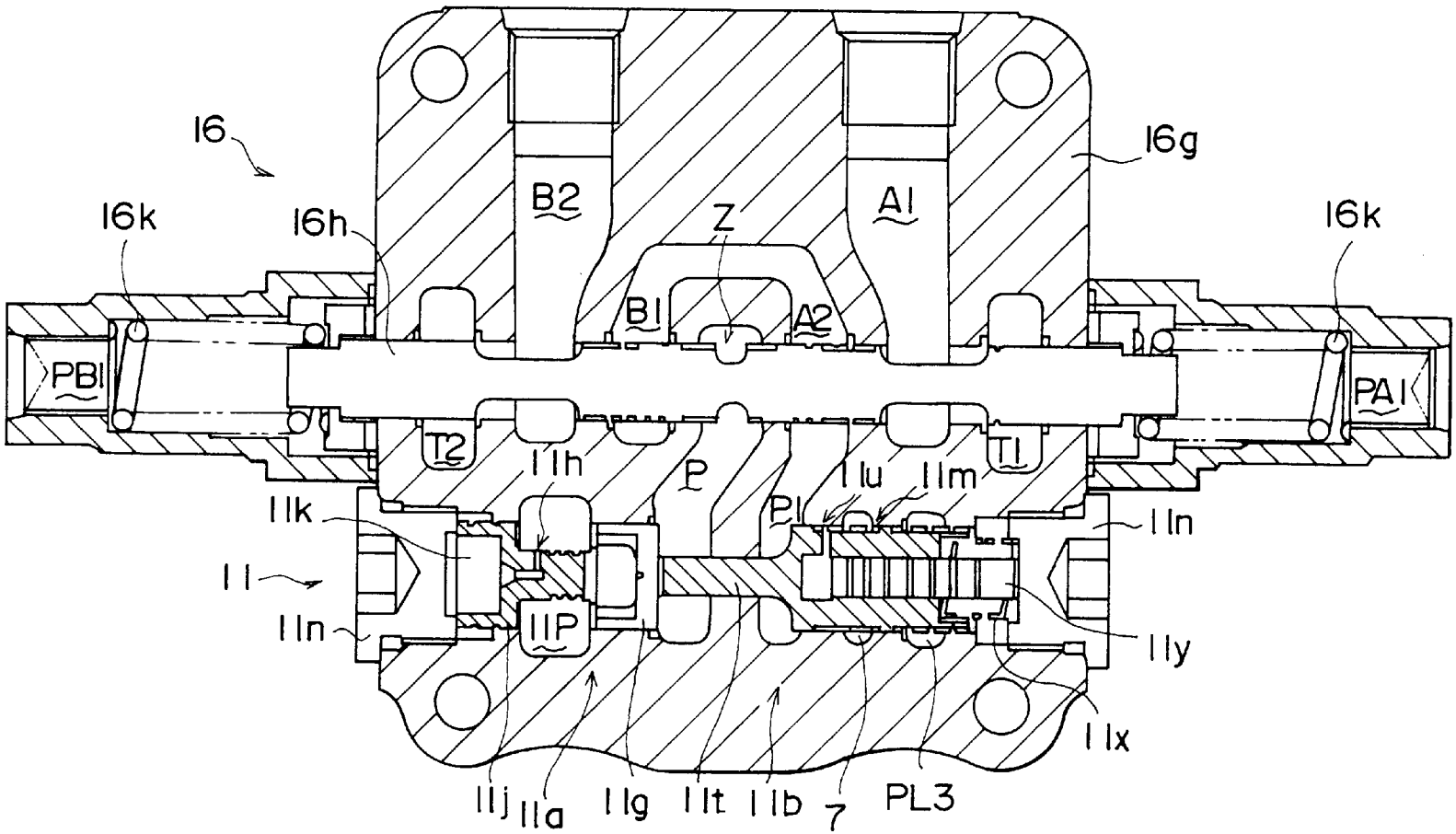
FIG. 8 is a cross sectional view of the feeder valve shown in FIG. 7.

In the ports of the feeder valve 16 shown in FIG. 8, the same parts have the same reference numbers as in FIG. 7. Thus, the description is omitted. A flow control valve 11*g* and a piston 11*j* with a throttle 11*h* are slidably inserted in a predetermined position of a valve body 16*g* in the flow rate regulating valve 11*a*. The oil is sealed by a plug 11*n* at one end. Numeral 11*k* denotes a pressure chamber of the piston 11*j*. The reducing valve 11*b* comprises a plunger 11*t* with a notch 11*m*, a pressure controlling spring 11*x*, and an interior piston 11*y*. The plunger 11*t* is slidably inserted in a predetermined position of the valve body 16*g* so that it can be in contact with the flow control valve 11*g*. The oil is sealed by the plug 11*n* at the other end. A spool 16*h* is held at a neutral position S4 about the pump port P by springs 16*k* and 16*k*, which are inserted in the respective hydraulic chambers PA1 and PB1 disposed at both ends thereof.

Figure 9A:
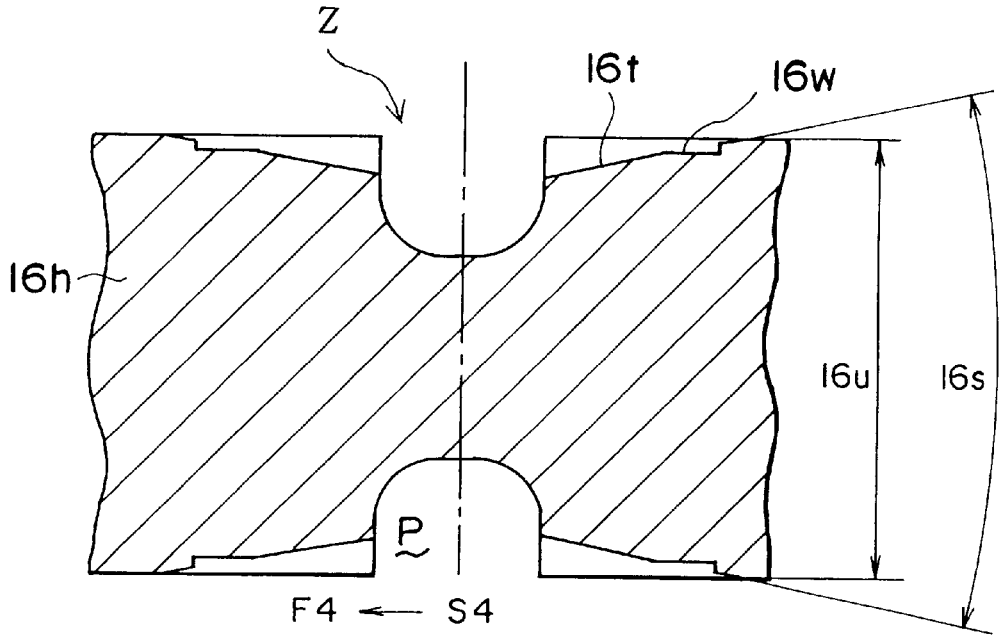
FIG. 9A is a partially enlarged view of FIG. 8.

FIG. 9A is an enlarged view of a portion Z showing the flow rate control mechanism PQ portion of the spool 16*h*. A parallel notch portion 16*w*, which is parallel to a spool outer circumference having the diameter 16*u*, is disposed in one part of a notch 16*t*, having a tapered shape 16*s*, for flowing a predetermined flow rate proportional to an opening area of the spool 16*h* in accordance with a required flow rate of the hydraulic motor 29*a* for the feeder 29. The spool 16*h* is moved from its neutral position S4, which is the center of the pump port P, toward the forward position F4 as shown by an arrow.

Figure 9B:
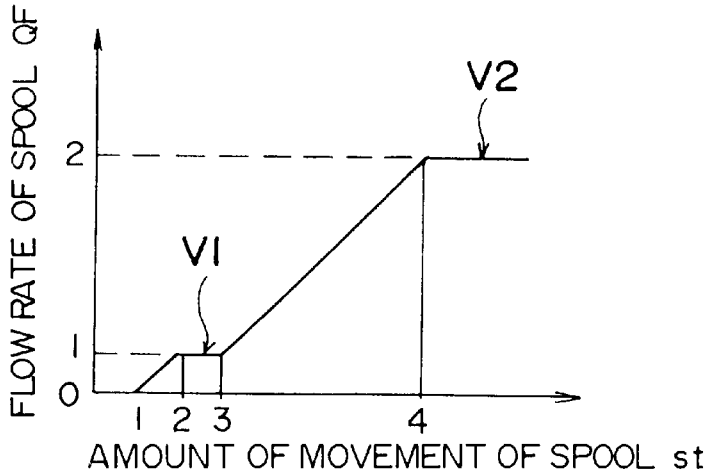
FIG. 9B is an illustration showing characteristics of flow rate relative to an amount of movement of a spool of the feeder valve.

FIG. 9B shows a relationship between an amount of movement st of the spool 16*h* and a flow rate QF of the spool flowing in the flow rate control mechanism PQ at that time. As the amount of the movement st of the spool 16*h* is increased from st1 to st2, the flow rate QF of the spool is increased from QF0 to QF1. When the amount of movement st reaches st2, the flow rate QF of the spool becomes constant QF1. The feeder 29 is actuated at a set value speed V1. When the amount of movement st exceeds st3, the flow rate QF of the spool is increased again. When the amount of movement st reaches st4, the flow rate QF of the spool becomes the maximum flow rate QF2. The feeder 29 is actuated at a rated speed V2.

Since the other discharge conveyor valve 17, the magnetic separator valve 18, the vibrating screen valve 19, the secondary loading conveyor valve 20, and the secondary stock conveyor valve 21 have the same structure as the feeder valve 16, the description is omitted.

Figure 10:
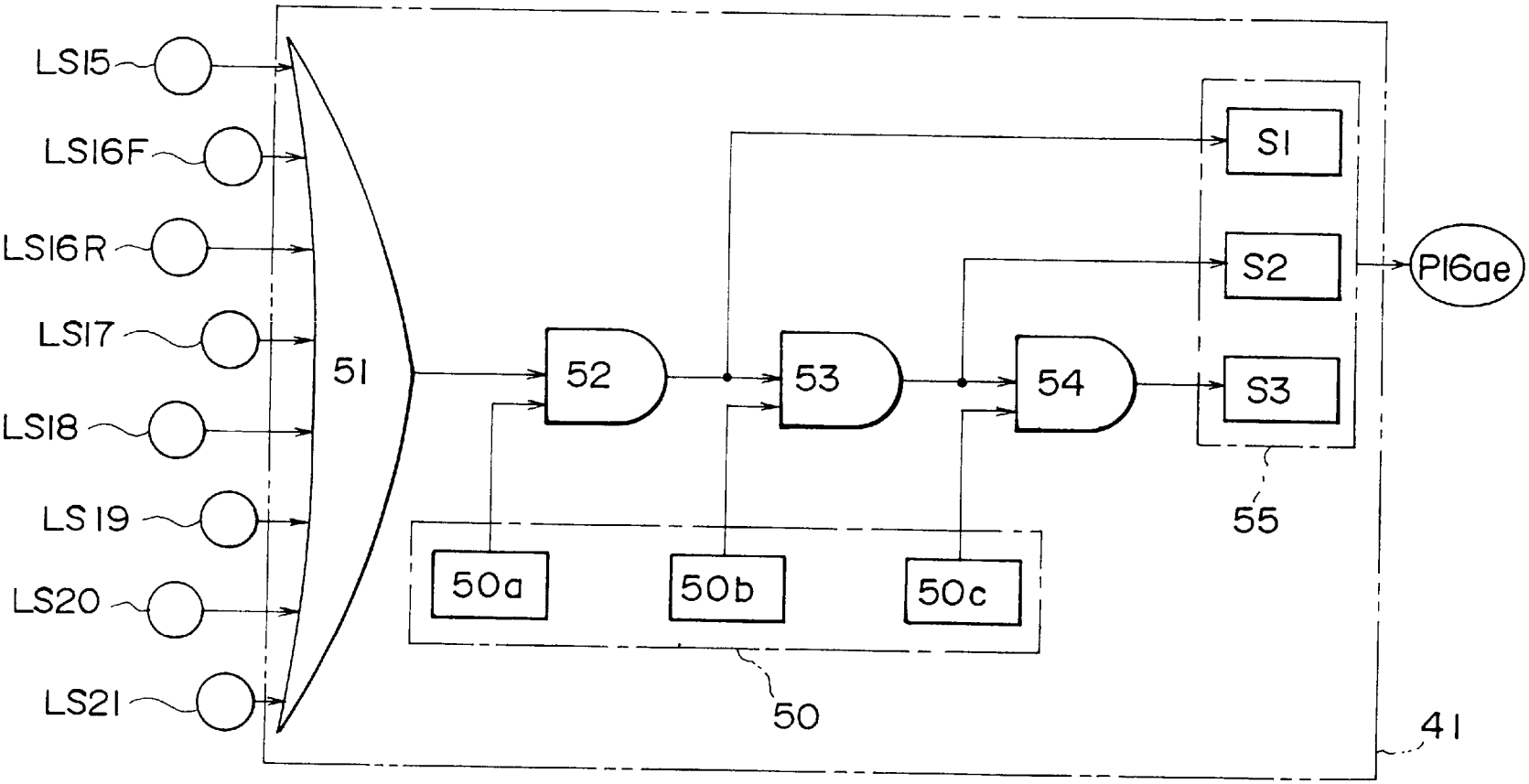
FIG. 10 is a circuit diagram showing an overload preventing circuit in the controller shown in FIG. 2.

Next, an overload preventing circuit of the transportable crusher disposed in the controller 41 will be described with reference to FIG. 10.

In the controller 41 are disposed a setter 50, for setting and outputting an equivalent load level to the signals from the sensors LS15, LS16F, LS16R, LS17, LS18, LS19, LS20, and LS21; an OR gate 51, for providing the output signal when a signal is inputted from any sensor; AND gates 52, 53, and 54, which are comparators; and an output circuit 55 for outputting the signal P16*ae* controlling the EPC valve P16*a* for forwardly rotating the feeder.

The setter 50 includes three kinds of circuits, that is, a first set signal circuit 50*a*, a second set signal circuit 50*b*, and a third set signal circuit 50*c*, for outputting a set signal which is preset when the signal is the set equivalent load level or higher.

The output circuit 55 includes a start control circuit S1 for starting the hydraulic motor 29*a* for the feeder by controlling the EPC valve P16*a* for forwardly rotating the feeder, an acceleration/deceleration control circuit S2 for accelerating/decelerating the hydraulic motor 29*a* for the feeder in the same manner, and a set value speed/stop control circuit S3 for operating at the set value speed or stopping the hydraulic motor 29*a* for the feeder in the same manner so as to output the signal P16*ae*.

When a signal from at least one of the sensors LS15, LS16F, LS16R, LS17, LS18, LS19, LS20, and LS21 is the set load pressure or higher, the signal is inputted to the OR gate 51.

When the output signal of the OR gate 51 and the signal of the first set signal circuit 50*a* are inputted to the AND gate 52, the AND gate 52 outputs signals to the AND gate 53 and the start control circuit S1. The EPC valve P16*a*, for forwardly rotating the feeder, switches the feeder valve 16 to the forward position F4 by the proportional current signal P16*ae* outputted from the start control circuit S1. The hydraulic motor 29*a* for the feeder is started.

When the output signal of the AND gate 52 and the signal of the second set signal circuit 50*b* are inputted to the AND gate 53, the AND gate 53 outputs signals to the AND gate 54 and the acceleration/deceleration control circuit S2. The EPC valve P16*a*, for forwardly rotating the feeder moves the feeder valve 16 within the forward position F4 responsive to the proportional current signal P16*ae* outputted from the acceleration/deceleration control circuit S2. The hydraulic motor 29*a* for the feeder is accelerated/decelerated.

When the output signal of the AND gate 53 and the signal of the third set signal circuit 50*c* are inputted to the AND gate 54, the AND gate 54 outputs a signal to the set value speed/stop control circuit S3. The EPC valve P16*a*, for forwardly rotating the feeder moves the feeder valve 16 responsive to the proportional current signal P16*ae*, outputted from the set value speed/stop control circuit S3, so as to operate the hydraulic motor 29*a* for the feeder at the set value speed. Alternatively, the EPC valve P16*a*, for forwardly rotating the feeder, switches the feeder valve 16 to the neutral position S4 so as to stop the hydraulic motor 29*a* for the feeder.

Figure 11:
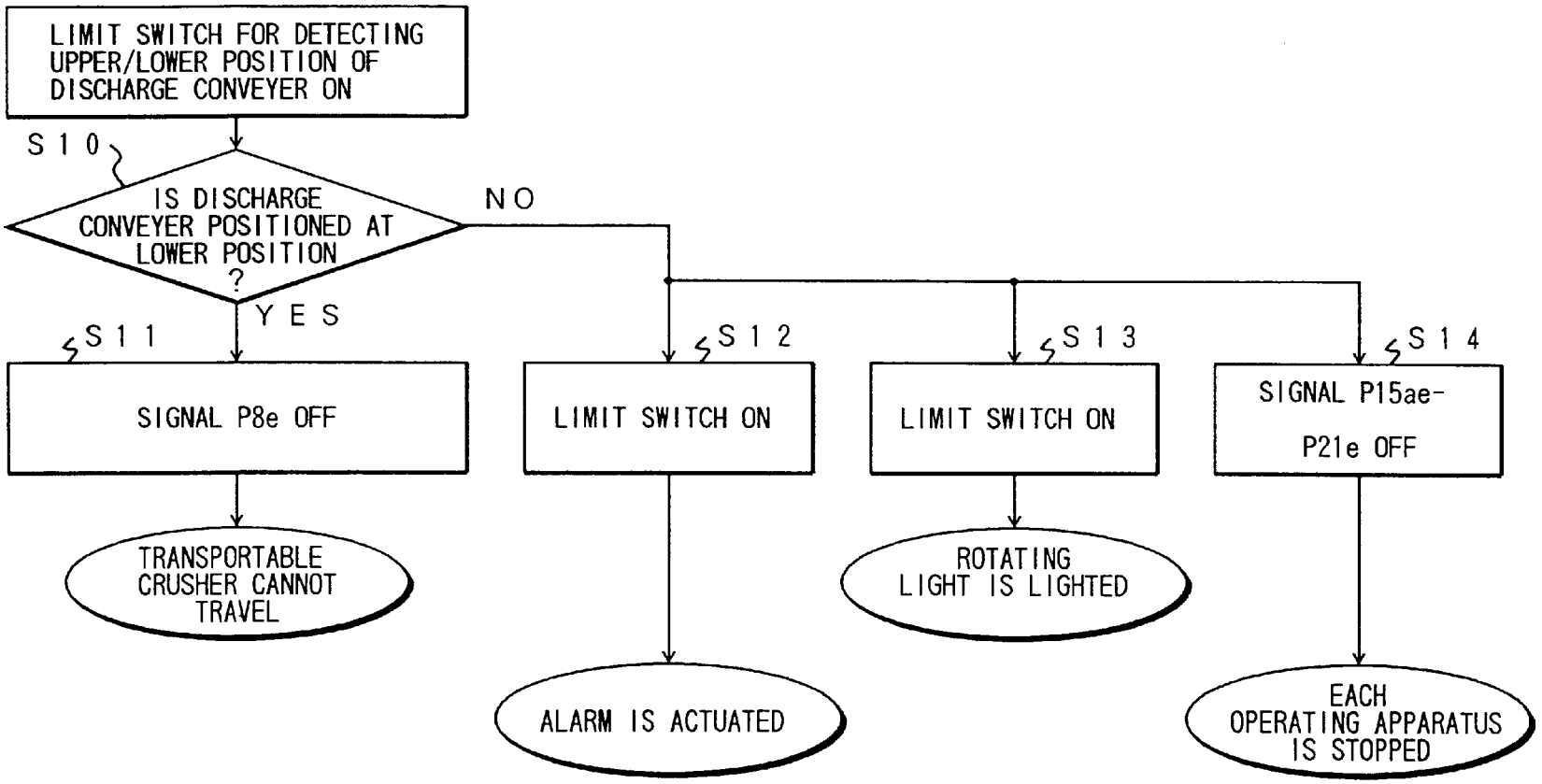
FIG. 11 is a flow chart of a traveling interlock circuit of a discharge conveyor.

Next, a traveling interlock circuit of the discharge conveyor 17 disposed in the controller 41 will be described with reference to the flow chart of FIG. 11.

The signal from the limit switch 43, which is turned ON/OFF depending on the upper position 42*b* or the lower position 42*a* of the discharge conveyor 30, is determined in a step S10. When the discharge conveyor 30 is positioned at the lower position 42*a,* YES is determined so that the operation proceeds to a step S11. The output signal P8*e* of the controller 41 is turned OFF so that the transportable crusher cannot travel.

When the discharge conveyor 30 is positioned at the upper position 42*b,* NO is determined so that the operation proceeds to steps S12, S13 and S14. That is, since the limit switch 43 is turned ON in the step S12, the alarm 46 blares. The rotating light 45 is activated in the same manner in the step S13. In the step S14, the signals P15*ae,* P15*be,* P16*ae,* P16*be,* P17*e,* P18*e,* P19*e,* P20*e,* and P21*e* are turned OFF from the controller 51 so as to stop the operation of each device.

Figure 12:
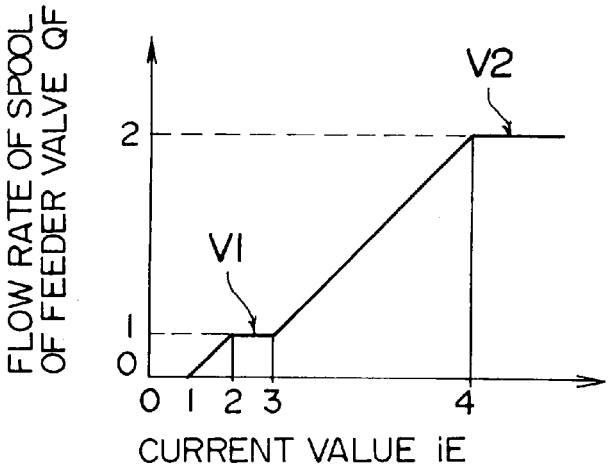
FIG. 12 is an illustration showing characteristics of flow rate relative to a current value of the feeder valve.

FIG. 12 is a characteristics diagram of the feeder valve 16, showing the flow rate QF of the spool of the feeder valve 16 on an ordinate axis and showing a current value iE of each solenoid proportional reducing valve which is the EPC valve P16*a* for forwardly rotating the feeder and the EPC valve 16*b* for reversely rotating the feeder on an abscissa axis.

As the current value iE is increased from iE to iE2, the flow rate QF of the spool is increased in proportion to the increase of the current value iE. When the current value iE reaches iE2, the flow rate QF of the spool becomes the constant flow rate QF1. The feeder 29 is actuated at the set value speed V1. When the current value iE is increased exceeding iE3, the flow rate QF of the spool is increased in proportion to this increase. When the current value iE reaches iE4, the flow rate QF of the spool becomes the maximum flow rate QF2. The feeder 29 is actuated at the rated speed V2.

Figure 13A:
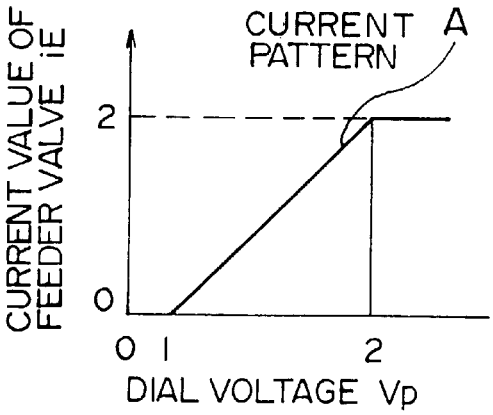
FIGS. 13A and 13B are graphs representing instruction tables classified by two kinds of feeders.
Figure 13B:
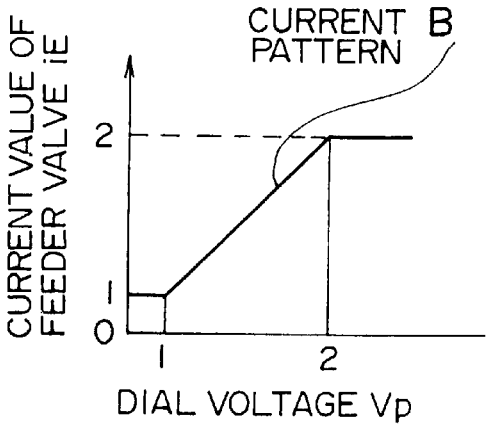
Figure 14:
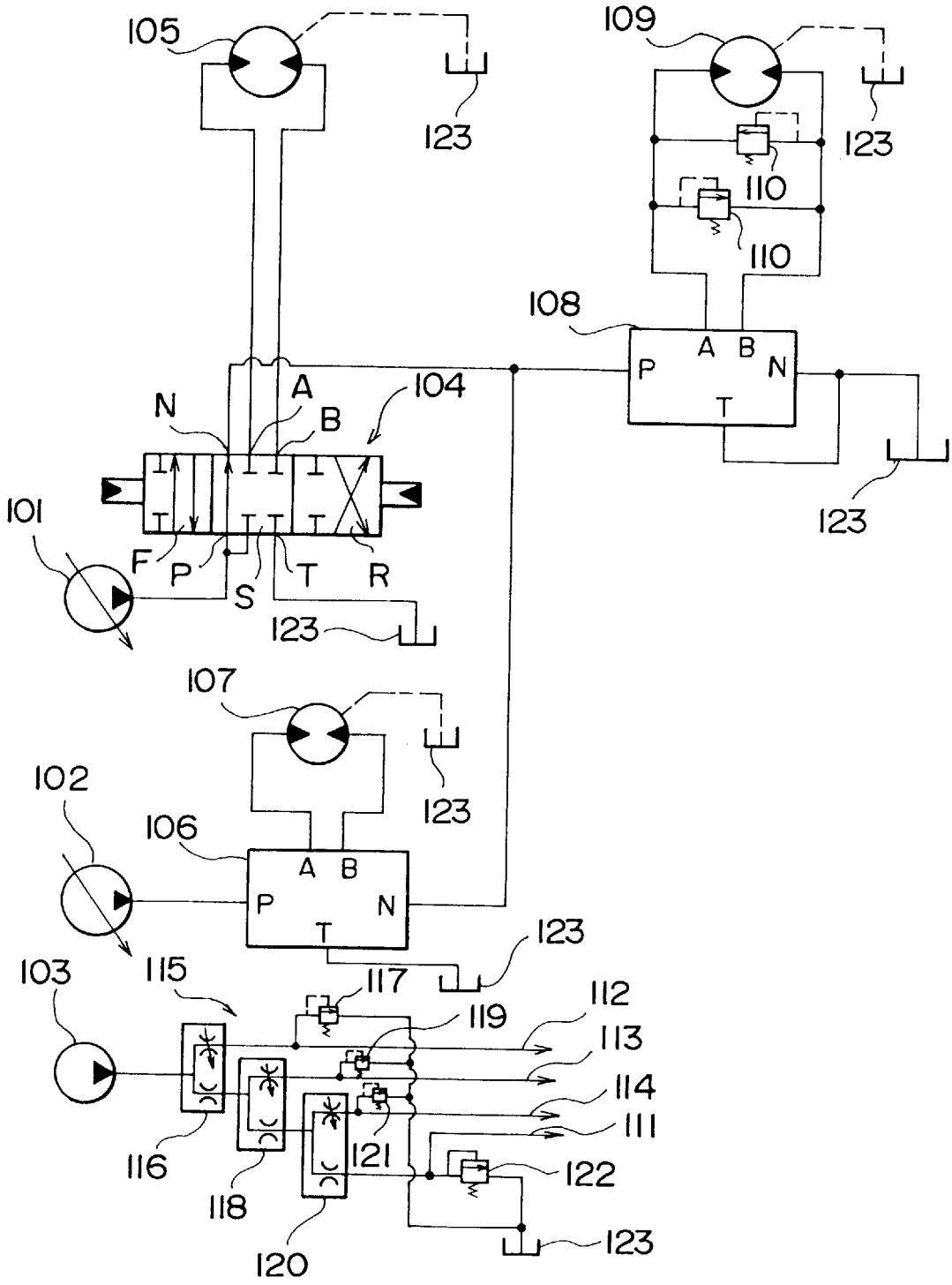
FIG. 14 PRIOR ART
FIG. 14 is a control circuit diagram of a transportable crusher of the prior art.
Figure 15:
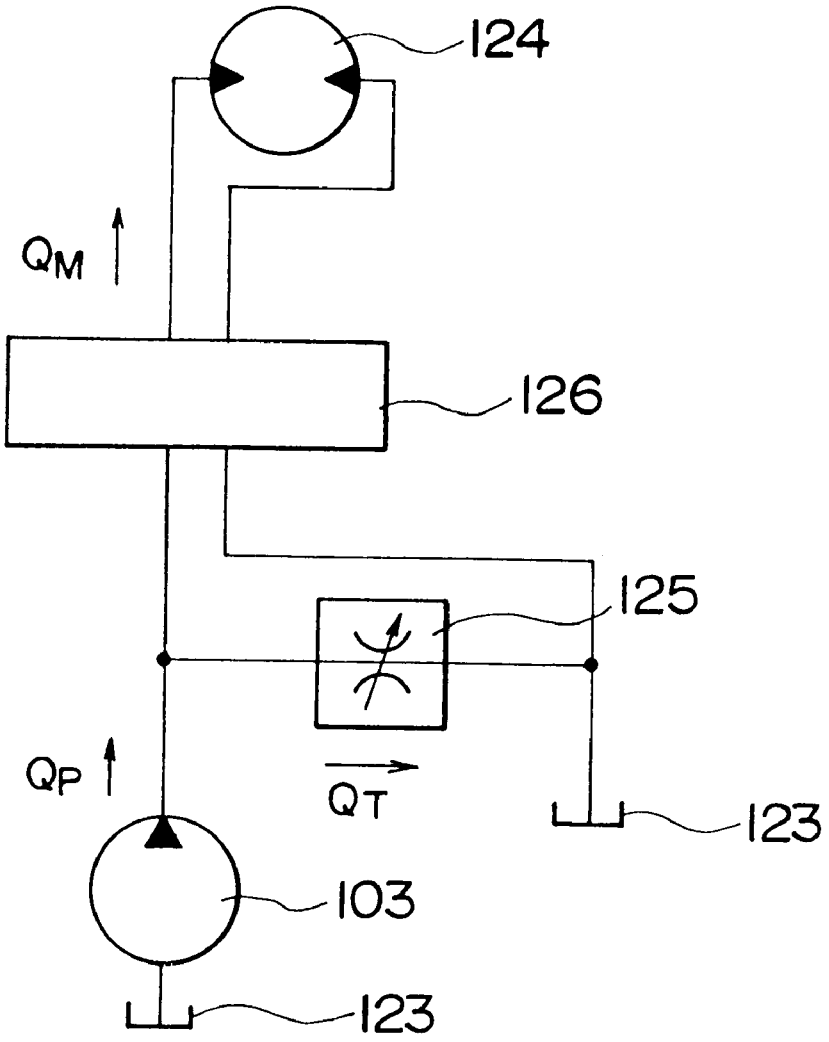
FIG. 15 PRIOR ART
FIG. 15 is a speed control circuit diagram of a hydraulic motor for the feeder of the prior art.

FIGS. 13A and 13B are instruction tables classified by two kinds of feeders, showing the current value iE of the feeder valve 16 on the ordinate axis and showing a dial voltage Vp set by the speed setter 49 of the feeder 29 on the abscissa axis. FIG. 13A shows a current pattern A for the plate feeder. FIG. 13B shows a current pattern B for the grizzly vibrating feeder. The instruction tables classified by these two kinds of feeders are stored in the controller 41. The operation of the feeder identification switch 56 shown in FIG. 2 is selected, and thereby each table can be read.

Next, the operation of the control circuit of the transportable crusher will be described with reference to FIG. 3.

When the transportable crusher is traveled, the remote controller 41*b* is operated so as to stop all the operating devices, that is, the crusher 28, the feeder 29, the discharge conveyor 30, the magnetic separator 31, the vibrating screen 32, the secondary loading conveyor 33 and the secondary stock conveyor 34. A rubber hose (not shown), connected to the vibrating screen 32, the secondary loading conveyor 33, and the a secondary stock conveyor 34, is cut off in a coupler section. Next, when the discharge conveyor 30 is stored in the upper position 42*b,* the preparation for the traveling is completed.

During the traveling of the transportable crusher, the amount of discharge Qp is supplied from the hydraulic pump 1 to the hydraulic motors 26*a* and 27*a* of the left and right traveling sections 26 and 27. Assume that the left and right traveling PPC valves P13 and P14 are operated to their position F2 so that they are advanced. The load pressure PLP of the left traveling section 26 is lower than that of the right traveling section 27, and the amount of discharge Qp is about to flow into the left traveling section 26. In this case, the pressure compensation valves 11 reduce to the same pressure as the load pressure PLP so that the differential pressure can be the same in the flow rate control mechanisms PQ between the inlet pump port P and the outlet control port A1 of the left and right traveling PPC valves P13 and P14. The compensation valves 11 compensate for the other pressure compensation valves 11 as the LS pressure in accordance with the load, while acting on the hydraulic pump 1 as the LS pressure PLS.

As a result, the amount of discharge Qp of the hydraulic pump 1 is distributed in proportion to an amount of operation of the left traveling valve 13 and the right traveling valve 14. Therefore, an advancement operation is facilitated without individually disposing a plurality of pumps. When the left and right traveling PPC valves P13 and P14 are operated to their position R2 so as to move backwardly, the operation is facilitated in the same manner as the advancement.

During the crushing operation of the transportable crusher by each operating device, in order to drive the actuator 25*a,* the hydraulic motor 28*a* for the crusher 28, the hydraulic motor 29*a* for the feeder 29, the hydraulic motor 30*a* for rotating the discharge conveyor 30, the hydraulic motor 31*a* for rotating the magnetic separator 31, the hydraulic motor 32*a* for rotating the vibrating screen 32, the hydraulic motor 33*a* for rotating the secondary loading conveyor 33, and the hydraulic motor 34*a* for rotating the secondary stock conveyor 34, each having a different required power, the hydraulic pump 1 supplies the amount of discharge Qp in parallel to them.

As is the case with the left and right traveling sections 26 and 27, the pressure compensation valves 11 reduce to the same pressure as the load pressure PLP so that the differential pressure can become the same in the flow rate control mechanisms PQ between the inlet pump port P and the outlet control port A1 or B2 of the closed-center type switch valves 12, 15, 16, 17, 18, 19, 20, and 21 for independently controlling the amount of discharge Qp to the hydraulic motors and actuators. The pressure compensation valves 11 compensate for the other pressure compensation valves 11 as the LS pressure in accordance with the load, while fetching the top pressure generated in the load pressure circuit LS12 and controlling as the LS pressure PLS.

This LS pressure PLS acts on the LS valve 5. The LS valve 5 is balanced so that the differential pressure between the hydraulic pressure Pp of the hydraulic pump 1 and the LS pressure PLS can be always constant.

As a result, the hydraulic pump 1 supplies the amount of discharge Qp so that the flow rate can be distributed in accordance with the amount of operation of the switch valves 12, 15, 16, 17, 18, 19, 20, and 21. Therefore, the hydraulic pump 1 is not required to be divided into several pumps for the crusher 28 and for the other operating devices. The single variable displacement hydraulic pump 1, having the amount of discharge Qp in accordance with the total required power, can be disposed. Accordingly, the pressurized oil, to be relieved from the relief valve 10 to the tank 22 for holding the pressure, is minimized by the pump control. This results in less heat generation in the hydraulic fluid in the tank 22.

This control circuit is not specifically limited to the single large displacement hydraulic pump 1. A plurality of small displacement hydraulic pumps can be attached so as to use the joined discharge flow rate. In this case, a large fixed displacement pump and a complicated distribution circuit are not disposed. Accordingly, a power loss of the pump can be reduced, and an overheating of the hydraulic fluid can be prevented.

The switch valves 12, 15, 16, 17, 18, 19, 20, and 21 distribute the amount of discharge Qp of the hydraulic pump 1 to the hydraulic motors and actuators 25*a*, 26*a*, 27*a*, 28*a*, 29*a*, 30*a*, 31*a*, 32*a*, 33*a*, and 34*a* in accordance with the amount of operation (opening area), not depending on the size of the load of the hydraulic motors and actuators. Thus, the crusher 28 driven by the large displacement hydraulic motor 28*a*, is actuated at a predetermined speed, even if the load of the hydraulic motor 28*a* is varied.

The feeder 29, the discharge conveyor 30, etc., or the like is actuated at a predetermined speed in the same manner, even if the loads of the hydraulic motors 29*a* and 30*a* are varied. As a result, the crusher 28 crushes the objects to be crushed at a constant speed and delivers the crushed objects to the discharge conveyor 30. Accordingly, the crushing efficiency is not reduced. Fewer emergency stops are caused due to the overloading of the crusher 28 and the discharge conveyor 30.

The crusher valve 15 and the feeder valve 16 are provided with the EPC valve P15*a* for forwardly rotating the crusher, the EPC valve P15*b* for reversely rotating the crusher, the EPC valve P16*a* for forwardly rotating the feeder, and the EPC valve 16*b* for reversely rotating the feeder, which are the solenoid proportional reducing valves for distributing the amount of discharge Qpa of the controlling hydraulic pump 2. Thus, when the crusher 28 crushes the objects to be crushed which have been introduced into the hopper 35, if the hydraulic motor 28*a*, 29*a*, or 30*a* of the feeder 29, the crusher 28, or the discharge conveyor 30 is overloaded, the amount of discharge Qp of the hydraulic pump 1 is distributed in the order of, for example, the crusher 28, the discharge conveyor 30, and the feeder 29 in accordance with a predetermined order of priority.

Consequently, the controller 41 instructs the feeder 29 to stop the delivery to the crusher 28 of the objects to be crushed. Next, the controller 41 gives the instruction to stop the discharge conveyor 30 after a predetermined time interval so as to stop the discharge conveyor 30. Within a predetermined time interval, the crusher 28 crushes the objects to be crushed in the crusher 28 and then discharges the crushed objects to the discharge conveyor 30. Finally, the controller 41 gives the instruction to stop the crusher 28 so that the crusher 28 is stopped. Thus, the crushed objects are not jammed into the crusher 28 and do not remain on the discharge conveyor 30. Accordingly, the check and maintenance work are facilitated. The overload is solved, thereby facilitating the automatic restoration of the controller 41.

When the feeder valve 16 is operated in order to start the feeder 29, as shown in FIGS. 9A and 9B, even if the amount of movement st of the spool is increased to expose more of the parallel notch portion 16*w*, which is parallel to the spool outer circumference represented by diameter 16*u*, in the notch 16*t* disposed in the spool 16*h*, the flow rate QF of the spool becomes constant. That is, the hydraulic motor 29*a* is actuated at the set value speed V1. The portion having the set value speed V1 is disposed, thereby allowing the feeder 29 to be easily actuated in each speed stage of the set value speed V1 and the rated speed V2. That is, the feeder 16 has characteristics allowing the feeder 29 to be actuated at the set value speed V1 and the rated speed V2 by the instruction from the controller 41.

The controller 41 can also select, with a dial by the speed setter 49, the first speed control for starting, accelerating/decelerating, and stopping the feeder 29 and the second speed control for starting, accelerating/decelerating, and operating at the set value speed the feeder 29. The feeder identification switch 56 is operated so as to select the instruction tables classified by the feeder type. Thus, it is possible to control the speed classified by two kind of feeders by the current pattern A for the plate feeder that is the first speed control and the current pattern B for the grizzly vibrating feeder that is the second speed control.

As a result, when the current pattern A is used for the plate feeder, the speed control of the plate feeder can be performed in proportion to the range from the stop to the rated speed.

Not only when the current pattern B is used for the grizzly vibrating feeder but also when it is used for the vibrating feeder having a resonant point at a low speed just before the stop, the set value speed operation is performed prior to the resonance of the vibrating feeder. After the reduction of the load of the crusher 28 and the discharge conveyor 30, the automatic restoration for accelerating the vibrating feeder to the rated speed is performed prior to the resonance of the vibrating feeder. After the reduction of the load of the crusher 28 and the discharge conveyor 30, the automatic restoration for accelerating the vibrating feeder to the rated speed is facilitated. Accordingly, the crushing efficiency is improved.

Even if the hydraulic motors for the plate feeder and for the vibrating feeder have different performances, the same hydraulic pump 1 and the switch valves of the operating valve assembly 8 can be used. Therefore, the assembly is facilitated.

When the discharge conveyor 30 is positioned at the lower position 42*a*, the limit switch 43, for turning ON/OFF the power source circuit 44, is turned OFF. The controller 41 turns OFF the instruction signal P8*e* so as to switch the traveling interlock solenoid valve P8. The pilot oil path P9 is connected to the tank 22. The amount of discharge Qpa of the hydraulic pump 2 is interrupted. Thus, the transportable crusher cannot travel. Accordingly, if the operator should inadvertently press a traveling lever of the transportable crusher during the crushing operation, the transportable crusher does not travel, thereby allowing safety to be ensured.

INDUSTRIAL APPLICABILITY

The present invention is useful as a control circuit of a transportable crusher which supplies, by the same pump, a required flow rate to hydraulic motors and actuators for a plurality of operating devices having different loads, improves simultaneous operability, fine adjustment, and reproducibility, prevents an overload of each device by setting an order of priority of operation/stop of plural operating devices, and has excellent safety during the traveling of the transportable crusher.

What is claimed is:

1. A control circuit for a transportable crusher having a plurality of hydraulic units for a plurality of operating devices having different loads during a crushing operation, wherein each hydraulic unit is selected from the group consisting of hydraulic motors and hydraulic actuators, said control circuit comprising:

at least one variable displacement hydraulic pump, for supplying a single discharge flow of hydraulic fluid;

a plurality of switch valves, each of said plurality of switch valves being for conducting and interrupting flow of hydraulic fluid from said at least one variable displacement hydraulic pump to a respective one of said hydraulic units;

a plurality of pressure compensation control valves, each of said plurality of pressure compensation control valves inputting a front pressure and a back pressure of a respective one of said switch valves for controlling a discharge flow rate of said single discharge flow from said at least one variable displacement hydraulic pump so that a difference between a respective front pressure and a corresponding back pressure can become constant; and a controller for controlling each of said switch valves to a predetermined value set in accordance with a load of said hydraulic units and for controlling said switch valves, when at least some of said switch valves are simultaneously operated and at least one of said hydraulic units is overloaded, to distribute said discharge flow rate among said switch valves in accordance with a predetermined priority.

2. A control circuit in accordance with claim 1, wherein one of said plurality of operating devices is a feeder, and wherein one of said hydraulic units is a feeder hydraulic motor for operating the feeder; said control circuit further comprising:

a feeder valve for controlling a speed of said feeder, said feeder valve having a spool which includes a tapered notch for flowing a flow rate proportional to an opening area of said spool in accordance with a flow rate required by the feeder hydraulic motor, said tapered notch including a parallel notch portion which is parallel to an outer circumference of the spool for allowing the flow rate through the feeder valve to be constant even if an amount of movement of said spool is increased to expose more of the parallel notch portion.

3. A control circuit in accordance with claim 1, wherein one of said plurality of operating devices is a feeder; wherein said plurality of hydraulic units includes a plurality of hydraulic motors, each of said hydraulic motors being for driving a respective one of said plurality of operating devices; and wherein said controller comprises:

a setter for presetting a load of said feeder;

a plurality of detectors, each of said detectors being for detecting a load of a hydraulic motor for driving a respective one of said plurality of operating devices;

a plurality of comparators, each of said comparators being for comparing signals inputted from said detectors to an equivalent load level to which said setter presets the load of said feeder;

a solenoid proportional reducing valve for said feeder; and an output circuit for outputting an instruction signal to said solenoid proportional reducing valve of said feeder in response to output signals of said comparators and for controlling a speed of said feeder.

4. A control circuit in accordance with claim 3, wherein one of said hydraulic motors is a feeder hydraulic motor for operating the feeder; said control circuit further comprising:

an identification switch; and wherein said controller comprises:

a current pattern A of a first speed control for starting, accelerating/decelerating, and stopping said feeder hydraulic motor; and a current pattern B of a second speed control for starting, accelerating/decelerating, and operating said feeder hydraulic motor at a set value speed; and wherein said controller gives an instruction to said solenoid proportional reducing valve in accordance with one of said current patterns selected by said identification switch so as to control a speed of said feeder.

5. A control circuit in accordance with claim 4, wherein one of said plurality of operating devices is a discharge conveyer; and further comprising:

a position sensor for detecting a storing position of said discharge conveyer, said position sensor being connected to said controller through a power source circuit, wherein said position sensor is turned OFF when said discharge conveyer is positioned at a position for a crushing operation; and a traveling interlock solenoid valve, wherein a signal from said controller to said traveling interlock solenoid valve is turned OFF when said discharge conveyer is positioned at a position for a crushing operation, so that a traveling of said transportable crusher is prevented.

6. A control circuit in accordance with claim 5, further comprising a rotating light and an alarm; and wherein said position sensor is connected to said rotating light and said alarm; and wherein said position sensor is turned ON when said discharge conveyer is positioned at said storing position during a stop of a crushing operation so that said rotating light and said alarm are actuated to provide a display of a traveling of said transportable crusher.

7. A control circuit in accordance with claim 6, further comprising:

a feeder valve for controlling a speed of said feeder, said feeder valve having a spool which includes a tapered notch for flowing a flow rate proportional to an opening area of said spool in accordance with a flow rate required by the feeder hydraulic motor, said tapered notch including a parallel notch portion which is parallel to an outer circumference of the spool for allowing the flow rate through the feeder valve to be constant even if an amount of movement of said spool is increased to expose more of the parallel notch portion.

8. A control circuit in accordance with claim 1, wherein one of said plurality of operating devices is a discharge conveyer; and further comprising:

a position sensor for detecting a storing position of said discharge conveyer, said position sensor being connected to said controller through a power source circuit, wherein said position sensor is turned OFF when said discharge conveyer is positioned at a position for a crushing operation; and a traveling interlock solenoid valve, wherein a signal from said controller to said traveling interlock solenoid valve is turned OFF when said discharge conveyer is positioned at a position for a crushing operation, so that a traveling of said transportable crusher is prevented.

9. A control circuit in accordance with claim 8, further comprising a rotating light and an alarm; and wherein said position sensor is connected to said rotating light and said alarm; and wherein said position sensor is turned ON when said discharge conveyer is positioned at said storing position during a stop of a crushing operation so that said rotating light and said alarm are actuated to provide a display of a traveling of said transportable crusher.

10. A control circuit in accordance with claim 1, wherein one of said plurality of operating devices is a feeder, and wherein one of said hydraulic units is a feeder hydraulic motor for operating the feeder; said control circuit further comprising:

an identification switch; and wherein said controller comprises:

a current pattern A of a first speed control for starting, accelerating/decelerating, and stopping said feeder hydraulic motor; and a current pattern B of a second speed control for starting, accelerating/decelerating, and operating said feeder hydraulic motor at a set value speed; and wherein said controller gives an instruction to operate said feeder hydraulic motor in accordance with one of said current patterns selected by said identification switch so as to control a speed of said feeder.

11. A control circuit in accordance with claim 1, wherein one of said plurality of operating devices is a discharge conveyer; and further comprising:

a position sensor for detecting a storing position of said discharge conveyer; and a traveling interlock solenoid valve, wherein said controller provides a signal to said traveling interlock solenoid valve so that a traveling of said transportable crusher is prevented when said position sensor detects that said discharge conveyer is not in said storing position.

12. A control circuit in accordance with claim 1, wherein one of said plurality of operating devices is a discharge conveyer; and further comprising:

an indicator; and a position sensor for detecting a storing position of said discharge conveyer, said position sensor being connected to said indicator so that said indicator can be actuated to provide a display of a traveling of said transportable crusher when said position sensor detects that said discharge conveyer is positioned at said storing position.

13. A control circuit in accordance with claim 1, wherein said at least one variable displacement hydraulic pump is a single variable displacement hydraulic pump.

14. A control circuit in accordance with claim 1, wherein said transportable crusher comprises a crusher, a feeder, and a discharge conveyor, wherein said plurality of hydraulic units include a hydraulic motor for driving said crusher, a hydraulic motor for driving said feeder, and a hydraulic motor for driving said discharge conveyor, and wherein distributing said discharge flow rate in accordance with said predetermined priority comprises distributing said discharge flow rate in the order of said crusher, said discharge conveyor, and said feeder.

15. A control circuit in accordance with claim 14, wherein, when one of said hydraulic units becomes overloaded, said controller stops said feeder, and then after a predetermined time interval stops said discharge conveyor and said crusher, wherein said predetermined time interval is sufficient for said crusher to crush objects within said crusher to be crushed and to deposit resulting crushed material on said discharge conveyor.

16. A transportable crusher comprising:

a plurality of operating devices having different loads during a crushing operation;

a plurality of hydraulic units for operating said plurality of operating devices during a crushing operation, wherein each hydraulic unit is selected from the group consisting of hydraulic motors and hydraulic actuators;

at least one variable displacement hydraulic pump, for supplying a single discharge flow of hydraulic fluid;

a plurality of switch valves, each of said plurality of switch valves being for conducting and interrupting flow of hydraulic fluid from said at least one variable displacement hydraulic pump to a respective one of said hydraulic units;

a plurality of pressure compensation control valves, each of said plurality of pressure compensation control valves inputting a front pressure and a back pressure of a respective one of said switch valves for controlling a discharge flow rate of said single discharge flow from said at least one variable displacement hydraulic pump so that a difference between a respective front pressure and a corresponding back pressure can become constant; and a controller for controlling each of said switch valves to a predetermined value set in accordance with a load of said hydraulic units, and for controlling said switch valves, when at least some of said switch valves are simultaneously operated and at least one of said hydraulic units is overloaded, to distribute said discharge flow rate among said switch valves in accordance with a predetermined priority.

17. A transportable crusher in accordance with claim 16, wherein one of said plurality of operating devices is a feeder, and wherein one of said hydraulic units is a feeder hydraulic motor for operating the feeder; said transportable crusher further comprising:

a feeder valve for controlling a speed of said feeder, said feeder valve having a spool which includes a tapered notch for flowing a flow rate proportional to an opening area of said spool in accordance with a flow rate required by the feeder hydraulic motor, said tapered notch including a parallel notch portion which is parallel to an outer circumference of the spool for allowing the flow rate through the feeder valve to be constant even if an amount of movement of said spool is increased to expose more of the parallel notch portion.

18. A transportable crusher in accordance with claim 16, wherein one of said plurality of operating devices is a feeder; wherein said plurality of hydraulic units includes a plurality of hydraulic motors, each of said hydraulic motors being for driving a respective one of said plurality of operating devices, and wherein said controller comprises:

a setter for presetting a load of said feeder;

a plurality of detectors, each of said detectors being for detecting a load of a hydraulic motor for driving a respective one of said plurality of operating devices;

a plurality of comparators, each of said comparators being for comparing signals inputted from said detectors to an equivalent load level to which said setter presets the load of said feeder;

a solenoid proportional reducing valve for said feeder; and an output circuit for outputting an instruction signal to said solenoid proportional reducing valve of said feeder in response to output signals of said comparators and for controlling a speed of said feeder.

19. A transportable crusher in accordance with claim 18, wherein one of said hydraulic motors is a feeder hydraulic motor for operating the feeder; said transportable crusher further comprising:

an identification switch; and wherein said controller comprises:

a current pattern A of a first speed control for starting, accelerating/decelerating, and stopping said feeder hydraulic motor; and a current pattern B of a second speed control for starting, accelerating/decelerating, and operating said feeder hydraulic motor at a set value speed; and wherein said controller gives an instruction to said solenoid proportional reducing valve in accordance with one of said current patterns selected by said identification switch so as to control a speed of said feeder.

20. A transportable crusher in accordance with claim 19, wherein one of said plurality of operating devices is a discharge conveyer; and further comprising:

a position sensor for detecting a storing position of said discharge conveyer, said position sensor being connected to said controller through a power source circuit, wherein said position sensor is turned OFF when said discharge conveyer is positioned at a position for a crushing operation; and a traveling interlock solenoid valve, wherein a signal from said controller to said traveling interlock solenoid valve is turned OFF when said discharge conveyer is positioned at a position for a crushing operation, so that a traveling of said transportable crusher is prevented.

21. A transportable crusher in accordance with claim 20, further comprising a rotating light and an alarm; and wherein said position sensor is connected to said rotating light and said alarm; and wherein said position sensor is turned ON when said discharge conveyer is positioned at said storing position during a stop of a crushing operation so that said rotating light and said alarm are actuated to provide a display of a traveling of said transportable crusher.

22. A transportable crusher in accordance with claim 21, wherein one of said hydraulic motors is a feeder hydraulic motor for operating the feeder, said transportable crusher further comprising:

a feeder valve for controlling a speed of said feeder, said feeder valve having a spool which includes a tapered notch for flowing a flow rate proportional to an opening area of said spool in accordance with a flow rate required by the feeder hydraulic motor, said tapered notch including a parallel notch portion which is parallel to an outer circumference of the spool for allowing the flow rate through the feeder valve to be constant even if an amount of movement of said spool is increased to expose more of the parallel notch portion.

23. A transportable crusher in accordance with claim 16, wherein one of said plurality of operating devices is a discharge conveyer; and further comprising:

a position sensor for detecting a storing position of said discharge conveyer, said position sensor being connected to said controller through a power source circuit, wherein said position sensor is turned OFF when said discharge conveyer is positioned at a position for a crushing operation; and a traveling interlock solenoid valve, wherein a signal from said controller to said traveling interlock solenoid valve is turned OFF when said discharge conveyer is positioned at a position for a crushing operation, so that a traveling of said transportable crusher is prevented.

24. A transportable crusher in accordance with claim 23, further comprising a rotating light and an alarm; and wherein said position sensor is connected to said rotating light and said alarm; and wherein said position sensor is turned ON when said discharge conveyer is positioned at storing position during a stop of a crushing operation so that said rotating light and said alarm are actuated to provide a display of a traveling of said transportable crusher.

25. A transportable crusher in accordance with claim 16, wherein one of said plurality of operating devices is a feeder, and wherein one of said hydraulic units is a feeder hydraulic motor for operating the feeder; said transportable crusher further comprising:

an identification switch; and wherein said controller comprises:

a current pattern A of a first speed control for starting, accelerating/decelerating, and stopping said feeder hydraulic motor; and a current pattern B of a second speed control for starting, accelerating/decelerating, and operating said feeder hydraulic motor at a set value speed; and wherein said controller gives an instruction to operate said feeder hydraulic motor in accordance with one of said current patterns selected by said identification switch so as to control a speed of said feeder.

26. A transportable crusher in accordance with claim 16, wherein one of said plurality of operating devices is a discharge conveyer; and further comprising:

a position sensor for detecting a storing position of said discharge conveyer; and a traveling interlock solenoid valve, wherein said controller provides a signal to said traveling interlock solenoid valve so that a traveling of said transportable crusher is prevented when said position sensor detects that said discharge conveyer is not in said storing position.

27. A control circuit in accordance with claim 16, wherein one of said plurality of operating devices is a discharge conveyer; and further comprising:

an indicator; and a position sensor for detecting a storing position of said discharge conveyer, said position sensor being connected to said indicator so that said indicator can be actuated to provide a display of a traveling of said transportable crusher when said position sensor detects that said discharge conveyer is positioned at said storing position.

28. A transportable crusher in accordance with claim 16, wherein said at least one variable displacement hydraulic pump is a single variable displacement hydraulic pump.

29. A transportable crusher in accordance with claim 16, wherein said transportable crusher comprises a crusher, a feeder, and a discharge conveyor, wherein said plurality of hydraulic units includes a hydraulic motor for driving said crusher, a hydraulic motor for driving said feeder, and a hydraulic motor for driving said discharge conveyor, and wherein distributing said discharge flow rate in accordance with said predetermined priority comprises distributing said discharge flow rate in the order of said crusher, said discharge conveyor, and said feeder.

30. A transportable crusher in accordance with claim 29, wherein, when one of said hydraulic units becomes overloaded, said controller stops said feeder, and then after a predetermined time interval stops said discharge conveyor and said crusher, wherein said predetermined time interval is sufficient for said crusher to crush objects within said crusher to be crushed and to deposit resulting crushed material on said discharge conveyor.

* * * * *